US007690744B2

(12) United States Patent
Nakanishi et al.

(10) Patent No.: US 7,690,744 B2
(45) Date of Patent: Apr. 6, 2010

(54) PRINTING APPARATUS FOR ASSIGNING DATA SUBJECTED TO DISCHARGE BY AN ABNORMAL NOZZLE IN ACCORDANCE WITH PREDETERMINED PRIORITIES

(75) Inventors: Hideki Nakanishi, Kanagawa (JP); Kazuhisa Kuruma, Kanagawa (JP); Takayuki Murata, Kanagawa (JP); Yuichiro Suzuki, Kanagawa (JP); Hitoshi Nishikori, Tokyo (JP); Masao Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 10/929,673

(22) Filed: Aug. 31, 2004

(65) Prior Publication Data

US 2005/0083361 A1 Apr. 21, 2005

(30) Foreign Application Priority Data

Sep. 3, 2003 (JP) ..... 2003-311341
Aug. 9, 2004 (JP) ..... 2004-232501

(51) Int. Cl.
*B41J 29/38* (2006.01)
*B41J 2/15* (2006.01)
*B41J 29/393* (2006.01)

(52) U.S. Cl. ..... 347/12; 347/19; 347/40

(58) Field of Classification Search ..... 347/12
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
5,581,284 A * 12/1996 Hermanson ..... 347/43
6,089,695 A 7/2000 Takagi et al.
6,126,341 A 10/2000 Tanaka et al. ..... 400/74
6,168,261 B1 1/2001 Miyake et al.
6,174,039 B1 1/2001 Miyake et al.
6,203,140 B1 * 3/2001 Oyen ..... 347/41
6,270,187 B1 * 8/2001 Murcia et al. ..... 347/43

(Continued)

FOREIGN PATENT DOCUMENTS

JP 6-79956 3/1994

(Continued)

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

A discharge failure nozzle, which cannot print, can be complemented by a printable discharge nozzle according to a simple, low-cost method capable of a high-speed process. A printing apparatus, which prints by using an inkjet head having nozzle arrays formed by arraying a plurality of nozzles for discharging ink while scanning the inkjet head on a printing medium, includes a storage unit which stores the position of an abnormal nozzle that abnormally discharges ink among the plurality of nozzles arrayed in the nozzle arrays, an assignment unit which assigns data subjected to discharge by the abnormal nozzle to a plurality of normal nozzles positioned near the abnormal nozzle in a nozzle array including the abnormal nozzle in accordance with predetermined priorities, and a control unit which controls to perform assignment of data subjected to discharge by the abnormal nozzle every time column data along the scanning direction are created by a predetermined number of columns.

1 Claim, 23 Drawing Sheets

U.S. PATENT DOCUMENTS

| | | | | |
|---|---|---|---|---|
| 6,347,855 | B1 | 2/2002 | Takanaka | |
| 6,354,689 | B1 * | 3/2002 | Couwenhoven et al. | 347/19 |
| 6,428,139 | B1 * | 8/2002 | Silverbrook | 347/19 |
| 6,450,613 | B1 * | 9/2002 | Rietbergen | 347/41 |
| 6,464,335 | B2 | 10/2002 | Suzuki | |
| 6,481,816 | B1 * | 11/2002 | Oyen | 347/12 |
| 6,513,895 | B2 * | 2/2003 | Bauer et al. | 347/14 |
| 6,520,623 | B2 | 2/2003 | Miyake et al. | |
| 6,575,549 | B1 * | 6/2003 | Silverbrook | 347/14 |
| 6,659,580 | B2 | 12/2003 | Horikoshi | |
| 6,979,068 | B2 * | 12/2005 | Kanematsu | 347/9 |
| 2002/0021325 | A1 | 2/2002 | Koitabashi et al. | |
| 2003/0085949 | A1 | 5/2003 | Koitabashi et al. | |
| 2004/0119766 | A1 * | 6/2004 | Shibata et al. | 347/12 |

FOREIGN PATENT DOCUMENTS

| | | |
|---|---|---|
| JP | 6-226982 | 8/1994 |
| JP | 8-25700 | 1/1996 |
| JP | 9-174824 | 7/1997 |
| JP | 11-77986 | 3/1999 |
| JP | 2000-94662 | 4/2000 |
| JP | 2001-010028 | 1/2001 |
| JP | 2001-010086 | 1/2001 |
| JP | 2001-353862 | 12/2001 |
| JP | 2002-19101 | 1/2002 |
| JP | 2003-205604 | 7/2003 |

* cited by examiner

PRINTING APPARATUS FOR ASSIGNING DATA SUBJECTED TO DISCHARGE BY AN ABNORMAL NOZZLE IN ACCORDANCE WITH PREDETERMINED PRIORITIES

FIELD OF THE INVENTION

This invention relates to a printing apparatus and, more particularly, to an inkjet printing apparatus.

BACKGROUND OF THE INVENTION

If a printhead having a plurality of nozzles in an inkjet printer includes even one discharge failure nozzle, a white stripe appears on a printed product, and the printed product cannot be used formally. When even one discharge failure nozzle exists in the printhead and the discharge failure occurs due to a cause which cannot be solved even by a recovery process, there has conventionally been no method of solving this printing failure except that the printhead having the discharge failure nozzle is not used. More specifically, when an unrecoverable discharge failure nozzle is detected during the manufacture of a printhead, the printhead having the discharge failure nozzle must be discarded. If a discharge failure nozzle unrecoverable by the recovery process is generated in the printhead after the printhead is passed to the user, the user must exchange the printhead.

Not only a discharge failure nozzle, but also a nozzle which cannot correctly print due to a discharge direction greatly deviated from a normal direction, and a nozzle which influences printing because the size of a discharged ink droplet is greatly different from a normal one are not suitable for normal printing. These nozzles are treated as abnormal nozzles, similar to the discharge failure nozzle. A printhead having such abnormal nozzle is regarded as a defective printhead.

This situation, i.e., generation of a discharge failure nozzle (to be also referred to as an abnormal nozzle hereinafter) in the printhead imposes an economic burden on both the printer manufacturer and user.

Recent printheads are equipped with a large number of printing nozzles. Some printheads have 512 nozzles per color, and when many nozzles are arranged for six colors, the printhead has a total of 3,072 nozzles. As the number of nozzles increases, the possibility at which discharge failure nozzles occur increases. Demands have arisen for a measure against a discharge failure nozzle so as to reduce the economic burden on both the printer manufacturer and user.

In order to avoid this situation, several printer manufacturers have recently proposed a technique associated with so-called discharge failure complement of complementing printing data of a discharge failure nozzle in the printhead. These proposals are similar to each other, and a representative example of the reference is Japanese Patent Publication Laid Open No. 6-226982. A feature of this technique is to print, when a discharge failure nozzle exists in the printhead, printing data at the position of the discharge failure nozzle by a normal nozzle.

For example, in multi-pass printing according to the complement method by a normal nozzle at the printing data position of a discharge failure nozzle, printing is done by one scanning in the main scanning direction, and then the sheet is fed in the sub-scanning direction. At this time, the sheet is not fed by the length of the printhead in the sub-scanning direction. In general, the sheet is fed by only a length obtained by dividing the length of the printhead by the multi-pass count. More specifically, when the printhead has 512 nozzles and performs printing which is completed by four passes, the sheet feed amount after one scanning in the main scanning direction is almost equal to a printhead length of 512÷4=128 nozzles. At this time, the same raster on the sheet surface is always printed by different nozzles of the printhead in respective passes. In the above example of 4-pass printing using 512 nozzles, a raster printed by the first nozzle counted from the upper end of the printhead in the first pass shifts by 128 nozzles in the second pass, and is identical to a raster printed by the 129th nozzle counted from the upper end of the printhead. From this principle, when the first nozzle counted from the upper end of the printhead is a discharge failure nozzle, data to be printed by the first nozzle is printed by the 129th nozzle counted from the upper end of the printhead in the second pass of 4-pass printing. In this manner, printing can be achieved by complementing the discharge failure of the first nozzle.

Also in single-pass printing, a discharge failure can be complemented in principle by setting a discharge failure complement printing pass in addition to a normal printing pass. Also in the above example, when the printhead has 512 nozzles and the first nozzle counted from the upper end of the printhead is a discharge failure nozzle, single-pass printing is normally executed in the first pass. The sheet is then fed by a printhead length of 128 nozzles, and the 129th nozzle counted from the upper end of the printhead prints data of the first nozzle. At this time, no printing is done by another nozzle, thereby implementing complement of a discharge failure.

There is also known an arrangement in which nozzles other than a discharge failure nozzle print in main scanning in the forward direction, then the sheet is slightly fed, and other nozzles print in an area not printed due to a discharge failure in scanning the carriage in the backward direction (see, e.g., Japanese Patent Publication Laid Open No. 8-25700).

To complement a discharge failure by the conventional method, the carriage must be scanned at least twice in the main scanning direction.

As another discharge failure complement method, for example, Japanese Patent Publication Laid Open No. 2002-19101 discloses a method of performing complement in the same scanning using a nozzle of another color, and a method of increasing the printing duty of a nozzle adjacent to a discharge failure nozzle and complementing a part which is not printed owing to a discharge failure.

Japanese Patent Publication Laid Open No. 06-079956 discloses an arrangement in which a printing block and complementary block are prepared, and when an abnormal nozzle is generated in the printing block, it is complemented by the nozzle of the complementary block.

Japanese Patent Publication Laid Open No. 09-174824 discloses an arrangement in which printing is performed using part of a nozzle array except its end, and when a discharge failure occurs at the end of the part used, discharge failure complement is done using an unused part.

However, the conventional discharge failure complement technique poses the following problems.

Multi-pass printing will be considered. One of printing methods often adopted in current printers is margin-less printing. In this printing mode, for A4 size, printing is done on the entire sheet surface of this size. Generally in this printing at portions corresponding to the upper and lower margins (margins in the sub-scanning direction) of a paper sheet, the sheet feed amount changes even by using the same multi-pass. In the above example of 4-pass printing using 512 nozzles, the sheet feed amount is almost equal to a printhead length of 128 nozzles, as described above. At portions corresponding to the upper and lower margins of a paper sheet, printing is done using not all the 512 nozzles, but only some nozzles, e.g., 128 nozzles. At this time, the sheet feed amount is 128÷4=32 nozzles. With this setting, a raster printed by the first nozzle counted from the upper end of the printhead shifts by 32 nozzles in the second pass, and is identical to a raster printed by the 33rd nozzle counted from the upper end of the printhead. According to this principle, the position of a complementable nozzle dynamically changes on the same printing sheet surface, unlike the case in which, when the first nozzle counted from the upper end of the printhead is a discharge failure nozzle, similar to the above-described example, it is unconditionally decided that data of the discharge failure nozzle can be complemented by the 129th nozzle counted from the upper end of the printhead. It is a heavy burden on the system to process in real time to a certain degree the dynamic relationship between a discharge failure nozzle and a complementary nozzle. A discharge failure cannot be complemented in practice if discharge failure nozzles exist in different nozzle arrays of the same printhead.

Discharge failure complement in the conventional single-pass printing described above requires redundant scanning in the main scanning direction for only the complement process, which actually decreases the printing speed.

In the method of complementing a discharge failure by using a nozzle adjacent to the discharge failure nozzle, the use frequency of the nozzle adjacent to the discharge failure nozzle excessively rises and greatly degrades due to the difference in use frequency from another nozzle not used for complement. This may lead to a short service life of the printhead, and this problem is desirably solved in an application to actual products.

As a method of eliminating redundant scanning in the main scanning direction for only the complement process, there is proposed the following discharge failure complement method. That is, discharge failure complement is completed not by multiple passes but by only one scanning in the main scanning direction. More specifically, when a discharge failure nozzle exists in the printhead, printing data assigned to this nozzle is distributed to a normal printing nozzle of the same nozzle array that exists near the discharge failure nozzle. This method can eliminate the need for a complicated data process over multiple passes even in discharge failure complement. No printing pass for only discharge failure complement exists, and a high-speed process can be easily achieved at a relatively low cost.

However, the conventional technique of completing discharge failure complement by only one scanning in the main scanning direction suffers the following problems.

That is, the method of distributing printing data assigned to a discharge failure nozzle to a normal printing nozzle of the same nozzle array that exists near the discharge failure nozzle generates nozzle positions at which discharge failure complement is physically impossible. These nozzle positions correspond to upper and lower nozzles.

For example, assume that a discharge failure occurs at the first or 512th nozzle at the upper or lower end of the head when the printhead has 512 nozzles per nozzle array. If the first nozzle is a discharge failure nozzle, it can be complemented by only a nozzle such as the second or third nozzle in a direction in which the nozzle number increases. This is because the printhead does not have any 0th or −1st nozzle. If the 512th nozzle is a discharge failure nozzle, it can be complemented by only a nozzle such as the 511th or 510th nozzle in a direction in which the nozzle number decreases. This is because the printhead does not have any 513th or 514th nozzle.

In this case, the nozzle position subjected to discharge failure complement shifts to the upper or lower nozzle of a discharge failure nozzle (which of the second and third nozzles corresponds to an upper or lower nozzle for the first nozzle, or which of the 511th and 510th nozzles corresponds to an upper or lower nozzle for the 512th nozzle depends on the design of the head structure and assignment of the nozzle number). This leads to degradation of the quality of a printed image. In discharge failure complement, the highest image quality is obtained only when upper and lower nozzles of a discharge failure nozzle can be uniformly used.

As described above, although the discharge failure complement method has conventionally been proposed, a further improvement is required in the implementation. Especially, an effective discharge failure complement technique of suppressing a decrease in printing speed by a simple method must be established.

SUMMARY OF THE INVENTION

The present invention has been made to overcome the conventional drawbacks, and can print by complementing a portion which is not printed by an unprintable discharge failure nozzle, by using a printable discharge nozzle according to a simple, low-cost method capable of a high-speed process so that the portion does not stand out.

In order to solve the above problems, the present invention relates to a printing apparatus which prints by using an inkjet head having an array of nozzles while scanning the inkjet head on a printing medium, and a data processing method for printing. Data subjected to discharge by an abnormal nozzle are assigned to a plurality of normal nozzles near the abnormal nozzle. This assignment is executed in accordance with predetermined priorities. In creating column data along the scanning direction, the assignment process of data subjected to discharge by the abnormal nozzle is performed every time data of a predetermined number of columns are created.

More specifically, according to the first aspect of the present invention, a printing apparatus which prints by using an inkjet head having nozzle arrays formed by arraying a plurality of nozzles for discharging ink while scanning the inkjet head on a printing medium is comprising storage means for storing a position of an abnormal nozzle which abnormally discharges ink among the plurality of nozzles arrayed in the nozzle arrays, means for assigning data subjected to discharge by the abnormal nozzle to a plurality of normal nozzles positioned near the abnormal nozzle in a nozzle array including the abnormal nozzle in accordance with predetermined priorities, and means for controlling to perform assignment of data subjected to discharge by the abnormal nozzle every time column data along a scanning direction are created by a predetermined number of columns.

According to the second aspect of the present invention, a data processing method used in printing by a printing apparatus which prints by using an ink-jet head having a nozzle array formed by arraying a plurality of nozzles for discharging ink while scanning the inkjet head on a printing medium is comprising creating data of each column along a scanning direction in correspondence with each of the plurality of nozzles of the nozzle array in the inkjet head, and assigning data subjected to discharge by an abnormal nozzle which generates a discharge failure among the plurality of nozzles arrayed in the nozzle array, to a plurality of normal nozzles positioned near the abnormal nozzle in accordance with predetermined priorities every time data of a predetermined number of columns are created.

According to the third aspect of the present invention, a printing apparatus which prints by using an inkjet head having a nozzle array formed by arraying a plurality of nozzles for discharging ink while scanning the inkjet head on a printing medium is wherein when at least one of nozzles positioned at two ends of the nozzle array is a discharge failure nozzle which cannot print, a complement process for the discharge failure nozzle is performed using nozzles which are positioned outside the nozzles positioned at the two ends and are not used in general printing operation.

According to the fourth aspect of the present invention, a printing method of printing by using an inkjet head having a nozzle array formed by arraying a plurality of nozzles for discharging ink while scanning the inkjet head on a printing medium is wherein when at least one of nozzles positioned at two ends of the nozzle array is a discharge failure nozzle which cannot print, a complement process for the discharge failure nozzle is performed using nozzles which are positioned outside the nozzles positioned at the two ends and are not used in general printing operation.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described in detail below in accordance with the accompanying drawings.

In the following embodiments, abnormal nozzles or discharge failure nozzles include a nozzle which fails in discharge, and a nozzle which cannot execute normal discharge and is treated as an abnormal nozzle because the discharge direction or the size of a discharged ink droplet is greatly different from that of a normal nozzle.

First Embodiment (1) Principle

A principle necessary to implement the first embodiment will be explained first.

Figure 2:
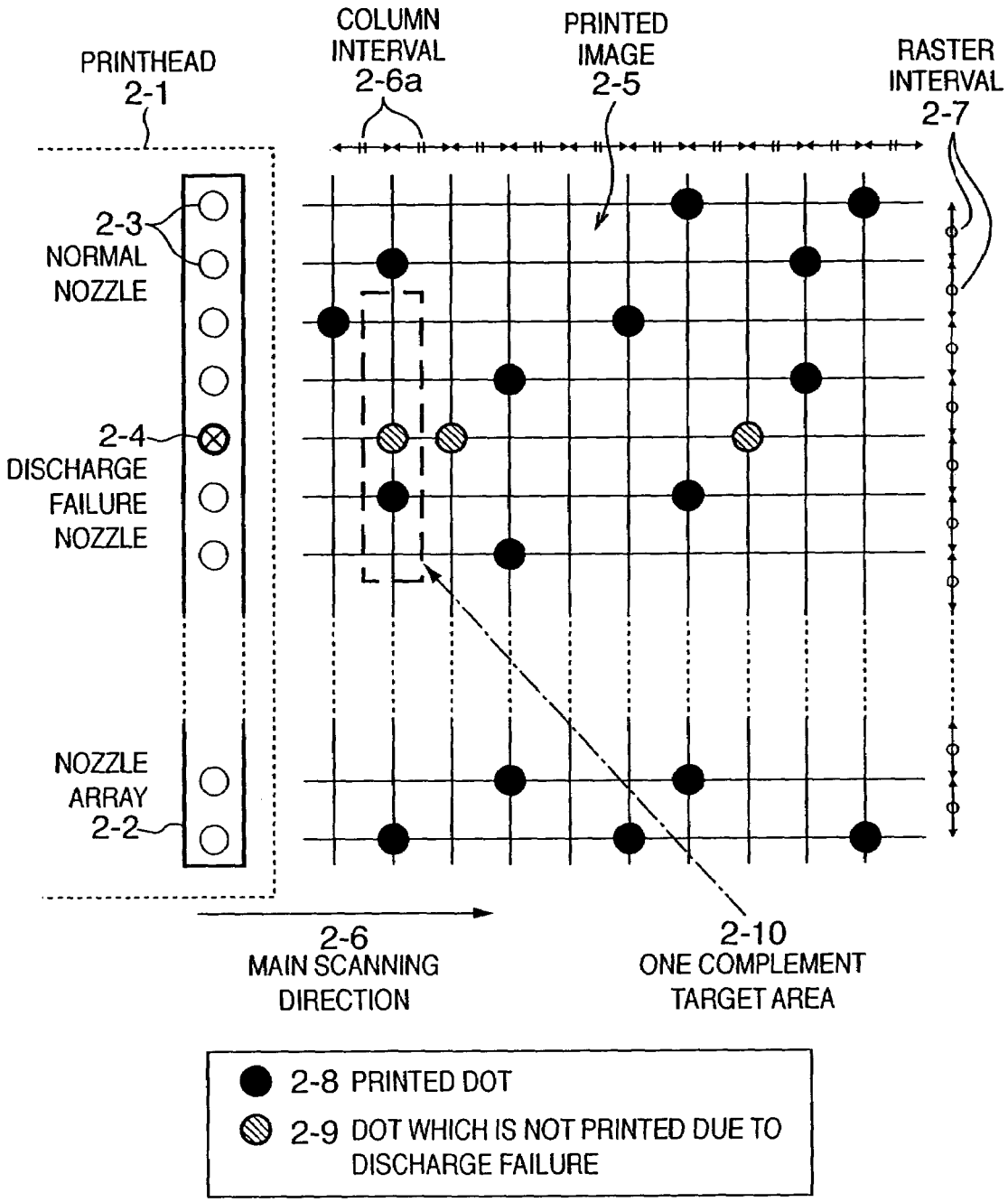
FIG. 2 is a complementary view for explaining the principle of discharge failure complement according to the first embodiment.

FIG. 2 is a view schematically showing a printing state in the presence of a discharge failure nozzle. FIG. 2 illustrates a specific nozzle array 2-2 extracted from a printhead 2-1. This nozzle array is formed by arraying a plurality of nozzles, and includes a discharge failure nozzle 2-4. In this example, the number of discharge failure nozzles is one, and many remaining nozzles are normal nozzles 2-3. Reference numeral 2-5 denotes a printed image which is formed on the sheet surface by the nozzle array 2-2 of the printhead 2-1. Assume that the printhead 2-1 prints the printed image 2-5 while moving in a main scanning direction 2-6. At this time, the discharge timing of the head is electrically determined, and the nozzle array 2-2 of the printhead 2-1 forms the printed image 2-5 while maintaining a specified interval=a column interval 2-6*a* in the scanning direction 2-6 and a specified interval=a raster interval 2-7 (which complies with the mechanical nozzle interval of the nozzle array 2-2 in many cases) in a direction perpendicular to the main scanning direction. The printed image 2-5 shown in FIG. 2 is an image printed when the printhead 2-1 scans once in the main scanning direction 2-6. In other words, the printed image 2-5 is not a printed image upon the completion of multi-pass printing by a plurality of scanning operations.

In this case, the normal nozzle 2-3 discharges ink to a print dot position 2-8 in the printed image 2-5. The discharge failure nozzle 2-4 should originally discharge ink to a print dot position 2-9, but does not discharge any ink to this position.

The purpose of the first embodiment is to make the print dot position 2-9 look as if a dot were printed at this position. In the following example, complement means not only complement achieved by forming a dot at a printing position corresponding to a discharge failure nozzle, but also complement of a discharge failure in appearance using several nozzles near a discharge failure nozzle.

A state in which a discharge failure dot within an area 2-10 is complemented will be explained by using only the area 2-10.

FIGS. 1A to 1D are views simply expressing the principle of discharge failure complement according to the first embodiment.

Figure 1A:
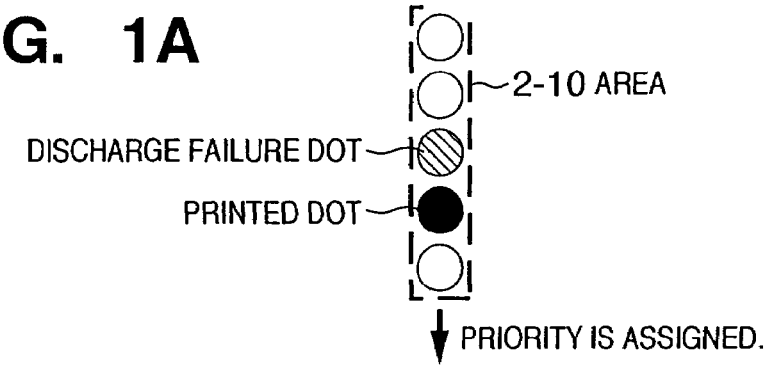
FIGS. 1A to 1D are views for explaining the principle of discharge failure complement according to the first embodiment.

FIG. 1A is a view showing one extracted complement target area 2-10 in FIG. 2. The complement target area 2-10 contains one printed dot and one dot which has not been printed due to a discharge failure.

Figure 1B:
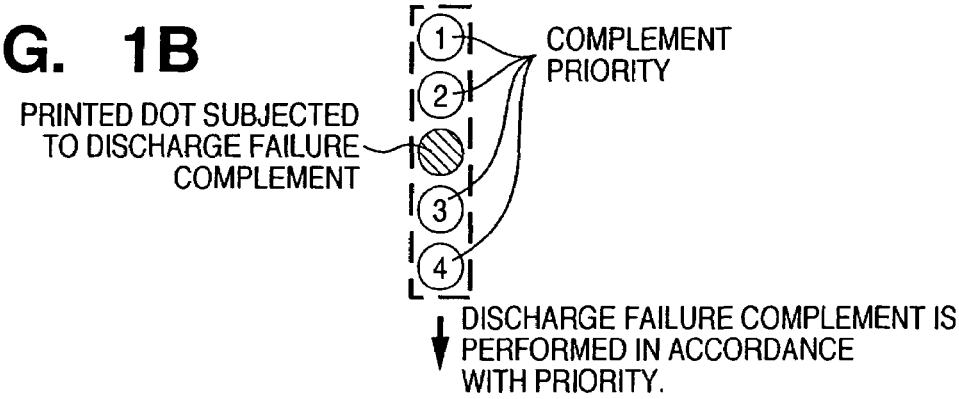

FIG. 1B shows a state in which priorities for complementing discharge failure dots are assigned to dot positions at which not a discharge failure nozzle but a printing nozzle exists and can print, other than the position of a discharge failure dot (this position corresponds to the dot position of the discharge failure nozzle 2-4 in the nozzle array 2-2), in order to complement the discharge failure dot shown in FIG. 1A. In this stage, priority numbers are assigned regardless of whether a dot to be printed exists at a dot position to be assigned a priority. In FIG. 1B, two upper nozzles and two lower nozzles of the discharge failure nozzle 2-4 shown in FIG. 1B are used for complement, and priorities are simply assigned from an upper nozzle in FIG. 1B in order of (1), (2), (3), and (4). These numbers may be assigned in a different order of, e.g., (2), (4), (1), and (3).

Figure 1C:
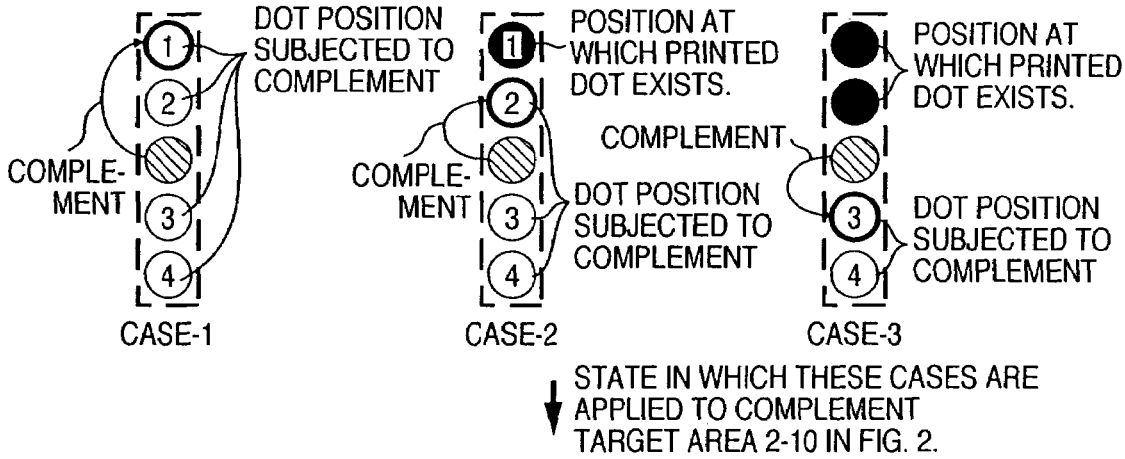

FIG. 1C shows states in which a discharge failure dot is complemented in accordance with the priorities assigned in FIG. 1B. In FIG. 1C, the pattern of printed dots in the area 2-10 is not fixed, unlike FIG. 1A. FIG. 1C illustrates how to complement a discharge failure dot in three cases.

Case 1 will be explained. In case 1, no printed dot and one dot which has not been printed due to a discharge failure exist. In this case, the dot which has not been printed due to a discharge failure directly shifts to a position of the highest discharge failure complement priority (i.e., dot complement is executed). In case 1, this position is the position of the first dot from the top in FIG. 1C (=dot having discharge failure complement priority (1)).

Case 2 will be explained. In case 2, one printed dot and one dot which has not been printed due to a discharge failure exist. The printed dot exists at a position having discharge failure complement priority (1). In this case, the dot which has not been printed due to a discharge failure shifts to a position of the highest discharge failure complement priority except discharge failure complement priority (1). In case 2, this position is the position of the second dot from the top in FIG. 1C (=dot having discharge failure complement priority (2)).

Case 3 will be explained. In case 3, two printed dots and one dot which has not been printed due to a discharge failure exist. The two printed dots exist at two positions: a position having discharge failure complement priority (1) and a position having discharge failure complement priority (2). In this case, the dot which has not been printed due to a discharge failure shifts to a position of the highest discharge failure complement priority except discharge failure complement priorities (1) and (2). In case 3, this position is the position of the second dot from the bottom in FIG. 1C (=dot having discharge failure complement priority (3)).

Discharge failure complement is performed on the basis of the above-described algorithm of observing discharge failure complement priorities assigned in the process of FIG. 1B and printed dots in the area 2-10, and executing dot complement at a dot position of the highest discharge failure complement priority among dot positions at which normal nozzles can print and have not printed yet.

Figure 1D:
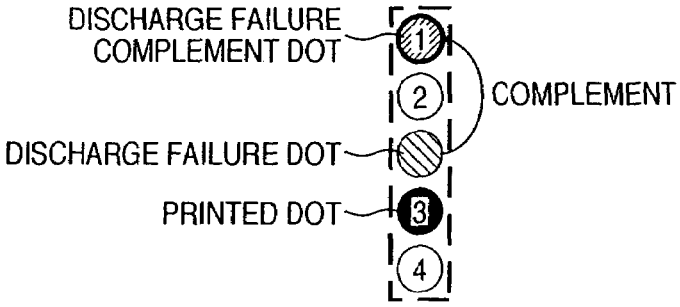

FIG. 1D shows a state in which discharge failure complement is performed in the example of FIG. 1A by applying this algorithm. When discharge failure complement priorities are assigned in the order of FIG. 1B, a printed dot exists at only a position of discharge failure complement priority (3) in FIG. 1A. In this case, complementable positions of discharge failure complement priorities are (1), (2), and (4), and complement is done at position (1) having the highest priority.

The features of the principle necessary to implement the first embodiment will be briefly summarized. First, when the printhead includes a discharge failure nozzle and data to be printed exists at the position of the discharge failure nozzle, data corresponding to the dot is moved (changed) so that the data is processed as data corresponding to an upper or lower normally printable nozzle near the discharge failure nozzle. Second, movement of the dot to be printed is determined on the basis of the relationship between a specified priority and printing data at a normal nozzle position subjected to discharge failure complement. Third, discharge failure complement is implemented by the first and second features, and complement for the discharge failure nozzle ends while the printhead scans once in the main scanning direction, thus achieving discharge failure complement in single-pass printing. That is, in the arrangement of the first embodiment, the printhead does not scan in the main scanning direction twice or more in order to complement one discharge failure nozzle, unlike the prior art.

The principle necessary to implement the first embodiment has been described.

(2) Arrangement and Data Flow

The arrangements of a printer and the like necessary to implement the first embodiment will be explained.

Figure 11:
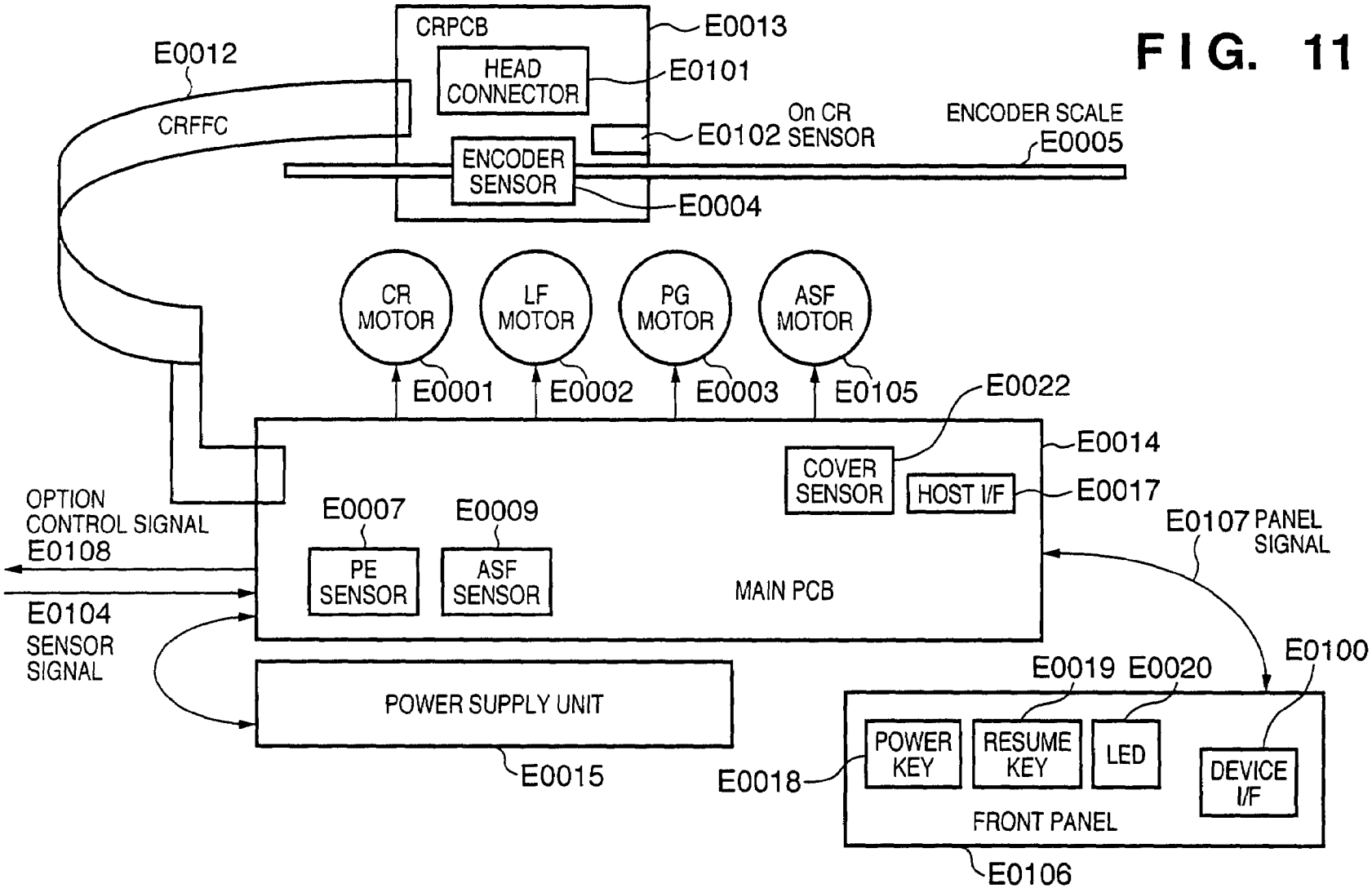
FIG. 11 is a block diagram schematically showing the overall configuration of an electric circuit in the first embodiment.

The configuration of an electrical circuit in the first embodiment of the present invention will be explained. FIG. 11 is a block diagram schematically showing the overall configuration of the electric circuit in the first embodiment.

The electric circuit in the first embodiment is mainly comprised of a carriage board (CRPCB) E0013, main PCB (Printed Circuit Board) E0014, power supply unit E0015, front panel E0106, and the like. The power supply unit E0015 is connected to the main PCB E0014, and supplies various driving powers. The carriage board E0013 is a printed board unit mounted on the carriage, and functions as an interface which exchanges signals with the printhead via a head connector E0101. In addition, the carriage board E0013 detects a change in the positional relationship between an encoder scale E0005 and an encoder sensor E0004 on the basis of a pulse signal output from the encoder sensor E0004 along with movement of the carriage, and outputs the output signal to the main PCB E0014 via a flexible flat cable (CRFFC) E0012. The carriage board E0013 supports an On CR sensor E0102, and outputs ambient temperature information of a thermistor and reflected light information of an optical sensor to the main PCB E0014 via the flexible flat cable (CRFFC) E0012 together with head temperature information of a printhead cartridge H1000.

The main PCB E0014 is a printed board unit which drives and controls each unit of the inkjet printing apparatus in the first embodiment. The board comprises a paper end detection sensor (PE sensor) E0007, automatic sheet feeder (ASF) sensor E0009, cover sensor E0022, and host interface (host I/F) E0017. The main PCB E0014 is connected to a motor (CR motor) E0001 serving as a driving source for scanning the carriage in the main scanning direction, a motor (LF motor) E0002 serving as a driving source for conveying a printing medium, a motor (PG motor) E0003 serving as a driving source for printhead recovery operation, and a motor (ASF motor) E0105 serving as a driving source for sheet feed operation of a printing medium. The main PCB E0014 drives and controls these motors. In addition, the main PCB E0014 comprises an input for sensor signals E0104 from an ink empty sensor, a medium (paper) determination sensor, a carriage position (height) sensor, an LF encoder sensor, a PG sensor, switch sensors representing the mounting/operation states of various optional units, and an output which outputs an option control signal E0108 for driving and controlling various optional units. The main PCB E0014 further comprises a connection interface (panel signal E0107) with the CRFFC E0012, power supply unit E0015, and front panel E0106. The front panel E0106 is a unit which is arranged on the front surface of the printer main body for convenience of user operation. The front panel E0106 comprises a resume key E0019, an LED E0020, a power key E0018, and a device I/F E0100 used to connect a peripheral device such as a digital camera.

Figure 12:
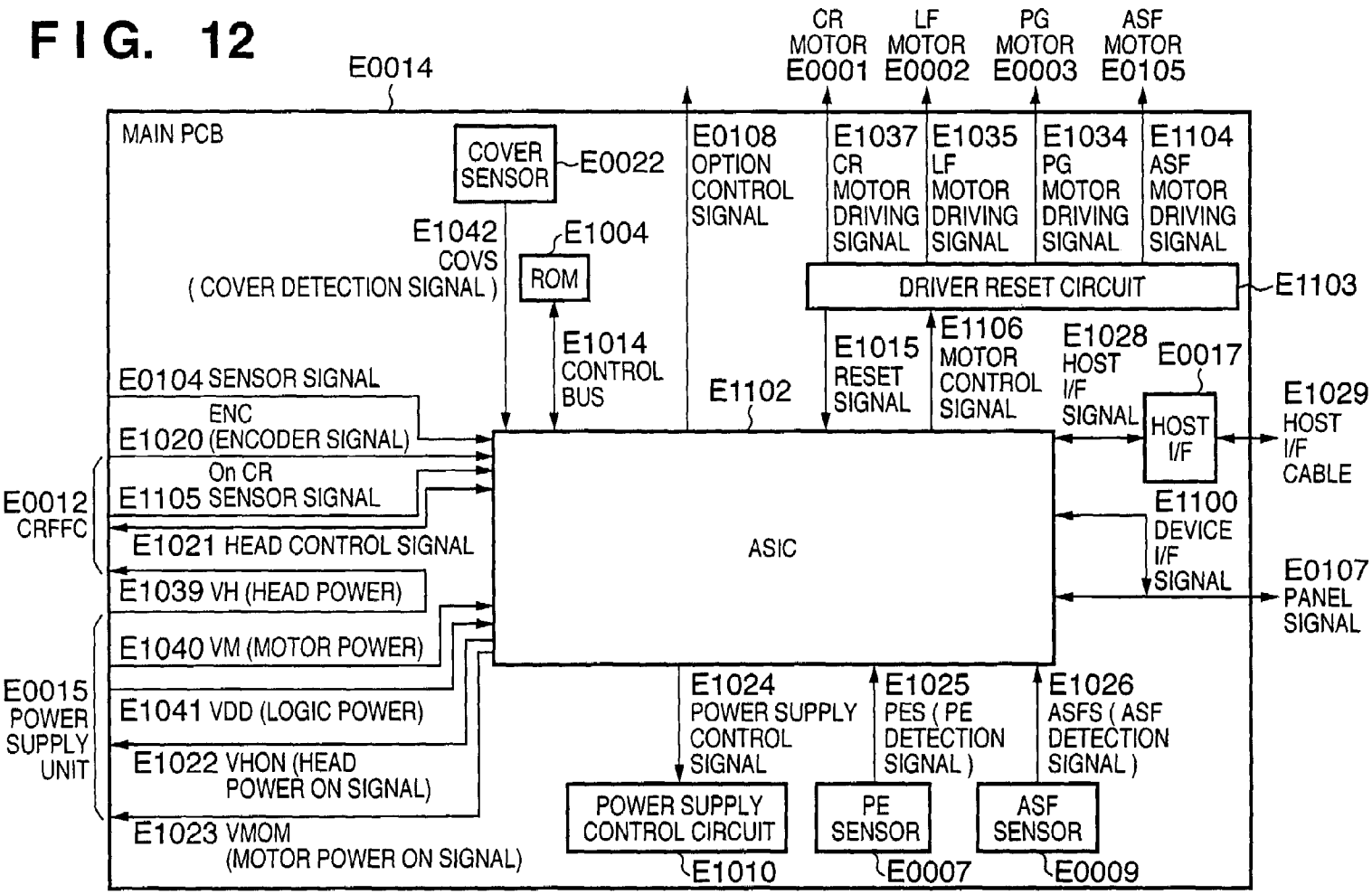
FIG. 12 is a block diagram showing the internal configuration of a main PCB.

FIG. 12 is a block diagram showing the internal configuration of the main PCB E0014. In FIG. 12, reference numeral E1102 denotes an ASIC (Application Specific Integrated Circuit) which is connected to a ROM E1004 via a control bus E1014. In accordance with a program stored in the ROM, the ASIC E1102 detects outputs from sensors on the main PCB E0014, input of the sensor signal E0104, an On CR sensor signal E1105 and encoder signal E1020 from the CRPCB E0013, and outputs from the power key E0018 and resume key E0019 on the front panel E0106. The ASIC E1102 performs various logical calculation/condition determination operations and the like in accordance with the connection/data input states of the host I/F E0017 and the device I/F E0100 on the front panel. The ASIC E1102 controls various building components described above and to be described later, and drives and controls the inkjet printing apparatus.

Reference numeral E1103 denotes a driver reset circuit which uses a motor power supply (VM) E1040 as a driving source. The driver reset circuit E1103 generates a CR motor driving signal E1037, LF motor driving signal E1035, PG motor driving signal E1034, and ASF motor driving signal E1104 in accordance with a motor control signal E1106 from the ASIC E1102, and drives the motors. The driver reset circuit E1103 comprises a power supply circuit, and supplies necessary powers (not shown) to respective units such as the main PCB E0014, CRPCB E0013, and front panel E0106. Further, the driver reset circuit E1103 detects a decrease in power supply voltage, and generates and initializes a reset signal E1015.

Reference numeral E1010 denotes a power supply control circuit which controls power supply to, e.g., each sensor having a light-emitting element in accordance with a power supply control signal E1024 from the ASIC E1102. The host I/F E0017 transmits a host I/F signal E1028 from the ASIC E1102 to an externally connected host I/F cable E1029, and transmits a signal from the cable E1029 to the ASIC E1102. The power supply control circuit E1010 receives a head power (VH) E1039, motor power (VM) E1040, and logic power (VDD) E1041 from the power supply unit E0015. A head power ON signal (VHON) E1022 and motor power ON signal (VMOM) E1023 from the ASIC E1102 are input to the power supply unit E0015 to control the ON/OFF states of the head power E1039 and motor power E1040. The logic power (VDD) E1041 supplied from the power supply unit E0015 is converted into a voltage, as needed, and then supplied to units inside and outside the main PCB E0014.

The head power signal E1039 is smoothed on the main PCB E0014, then sent to the CRFFC E0012, and used to drive the printhead cartridge H1000. The ASIC E1102 is a 1-chip semiconductor integrated circuit incorporating a processor. The ASIC E1102 outputs the motor control signal E1106, option control signal E0108, power supply control signal E1024, head power ON signal E1022, motor power ON signal E1023, and the like. The ASIC E1102 exchanges signals with the host I/F E0017, and exchanges signals with the device I/F E0100 on the front panel via the panel signal E0107. The ASIC E1102 detects the states of a PE detection signal (PES) E1025 from the PE sensor E0007, an ASF detection signal (ASFS) E1026 from the ASF sensor E0009, a cover detection signal (COVS) E1042 from the cover sensor E0022, the panel signal E0107, the sensor signal E0104, and the On CR sensor signal E1105. The ASIC E1102 controls driving of the panel signal E0107, and flickers the LED E0020 on the front panel.

Also, the ASIC E1102 detects the state of the encoder signal (ENC) E1020, generates a timing signal, interfaces the printhead cartridge H1000 by using a head control signal E1021, and controls printing operation. The encoder signal (ENC) E1020 is an output signal which is input from the CR encoder sensor E0004 via the CRFFC E0012. The head control signal E1021 is supplied to the printhead cartridge H1000 via the flexible flat cable E0012, carriage board E0013, and head connector E0101.

Figure 3:
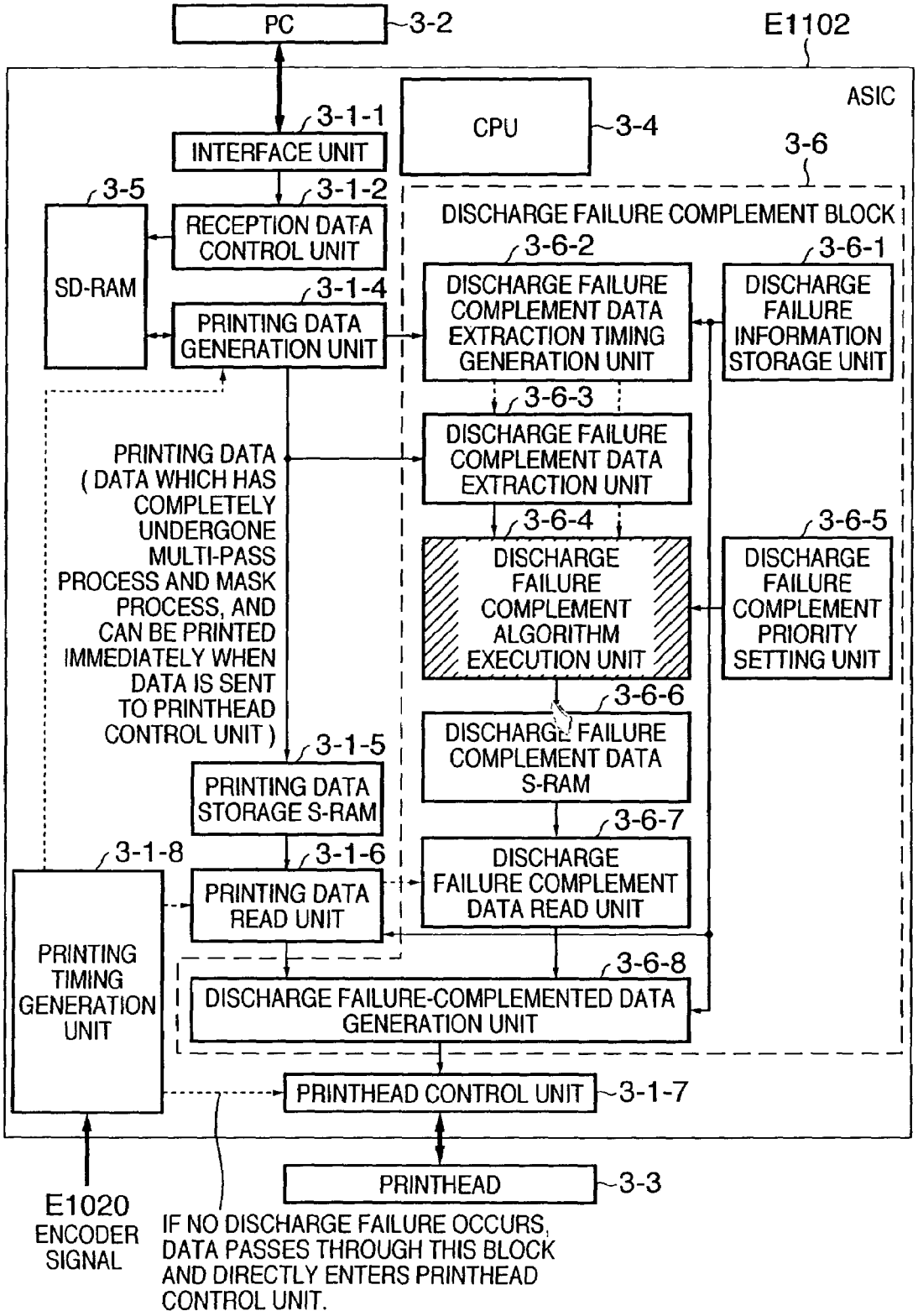
FIG. 3 is a block diagram showing the configuration of a discharge failure complement system according to the first embodiment.

FIG. 3 is a block diagram showing the internal configuration of the ASIC E1102 and its schematic data flow.

The ASIC of an actual printer has a structure more complicated than that of FIG. 3. In this case, the internal configuration only of parts associated with the discharge failure complement function according to the first embodiment will be explained.

In a description of the data flow of the discharge failure complement function, two elements are necessary in addition to the ASIC E1102 for easy understanding of the function. One element is a personal computer (PC) 3-2 serving as a host device which is connected outside the printer and performs transmission of printing data to the printer, control of the printer, and the like in accordance with a driver program. The other element is a printhead 3-3. The PC 3-2 exists outside the printer incorporating the discharge failure complement function of the first embodiment. The PC 3-2 transfers printing data to the printer, more strictly, to the data reception unit of the ASIC E1102. The printhead 3-3 is a head which generates a printed output as a printer product. As described in the principle, the printhead 3-3 includes a discharge failure nozzle in addition to normal printing nozzles. Data for controlling the operation of the printhead 3-3, i.e., printing data, a discharge pulse signal, and the like are generated within the ASIC E1102.

The internal configuration of the ASIC E1102 will be explained.

Main blocks will be described. Reference numeral 3-4 denotes a CPU which controls and manages the whole operation of the ASIC E1102; and 3-5, an SD-RAM serving as a main memory for the printer system of the first embodiment. The main memory need not always be an SD-RAM, and may be a memory such as a D-RAM or S-RAM other than the SD-RAM as far as the memory belongs to the definition of the RAM. The remaining blocks in the ASIC E1102 form a so-called random logic part which implements an operation unique to the printer and an operation unique to the discharge failure complement function according to the first embodiment.

The random logic part will be explained.

Reference numeral 3-1-1 denotes an interface unit which receives data transferred from the PC 3-2. For example, the interface unit 3-1-1 receives a signal in accordance with an interface protocol complying with IEEE1284, USB, IEEE1394, or the like, and generates data in a format easily processible by the ASIC E1102 (in general, data is shaped into each byte). Data received into the ASIC E1102 via the interface unit 3-1-1 is sent to a reception data control unit 3-1-2. The function of the reception data control unit 3-1-2 is to receive data from the interface unit 3-1-1 and save the data in the SD-RAM 3-5. Part of the SD-RAM 3-5 that is controlled by the reception data control unit 3-1-2 is often called a reception buffer.

Data saved in the SD-RAM 3-5 by the reception data control unit 3-1-2 is loaded into a printing data generation unit 3-1-4 in accordance with each printing control timing, thus generating printing data. In general, the printing data generation unit 3-1-4 is divided into various functions for different roles such as an H-V conversion unit, data mapping unit, and multi-pass mask control unit. When the respective functions access the SD-RAM 3-5 and perform data processes by their own functions, access areas in the SD-RAM 3-5 are generally called by different names, i.e., a work buffer, print buffer, mask buffer, and the like. These functions are substantially irrelevant to the discharge failure complement function and are called a "printing data generation unit" as a whole, and a detailed description thereof will be omitted.

Printing data created by the printing data generation unit 3-1-4 is saved in a printing data storage S-RAM 3-1-5. The printing data storage S-RAM 3-1-5 is not indispensable to the system. In many cases, recent printers generate a large amount of printing data in advance to increase the printing speed. Such printing data is often temporarily stored in a high-speed accessible memory such as an S-RAM (Static RAM) (in this case, a D-RAM (Dynamic RAM) memory takes a longer access time than that of an S-RAM because refresh operation must be done within a predetermined time, and the S-RAM accessible at high speed is preferably applied). It is important that the target printing data is data having completely undergone various data processes such as a multi-pass process, index data mapping, and a mask process. The data can be printed immediately when the printing data is sent to a printhead control unit. The discharge failure complement function of the first embodiment further executes the discharge failure complement process for the data.

Printing data is read out from the printing data storage S-RAM 3-1-5 to a printing data read unit 3-1-6. At this time, if no discharge failure nozzle exists in the printhead 3-3, the data read out to the printing data read unit 3-1-6 is directly sent to a printhead control unit 3-1-7. The printhead control unit 3-1-7 performs hardware control unique to the printhead 3-3 so that the printhead control unit 3-1-7 transfers the received printing data to the printhead 3-3 or transfers a heat pulse signal to the printhead 3-3.

The ASIC E1102 also comprises a printing timing generation unit 3-1-8 which generates various printing timings from the encoder signal E1020. The printing timing generation unit 3-1-8 generates signals at a proper interval from the encoder signal E1020 so as to allow the printing data generation unit 3-1-4, the printing data read unit 3-1-6, the printhead control unit 3-1-7, and a discharge failure complement data read unit 3-6-7 (to be described later) exchange data at proper timings.

Parts associated with the discharge failure complement function of the first embodiment will be explained. Blocks associated with the discharge failure complement function are blocks in the area of a discharge failure complement block 3-6 surrounded by the broken line in the ASIC E1102.

A discharge failure information storage unit 3-6-1 is necessary, and sets a nozzle position at which a discharge failure nozzle exists in the printhead. This setting is done by the CPU 3-4. Discharge failure nozzle information set in the discharge failure information storage unit 3-6-1 is transferred to a discharge failure complement data extraction timing generation unit 3-6-2, the printing data read unit 3-1-6, and a discharge failure-complemented data generation unit 3-6-8.

The discharge failure complement data extraction timing generation unit 3-6-2 generates a discharge failure complement data extraction timing signal on the basis of the transferred data. The printing data generation unit 3-1-4 can generate data of the current nozzle (regardless of whether the nozzle is a normal one or discharge failure one) of the printhead 3-3, and determine whether data is written in the printing data storage S-RAM 3-1-5. By receiving from the printing data generation unit 3-1-4 information on the relationship between currently processed printing data and a nozzle in the printhead 3-3, it can be determined whether the currently processed data is discharge data of a discharge failure nozzle or discharge data of upper and lower nozzle positions of the discharge failure nozzle at which discharge failure complement should be executed, as described in the principle. If the printhead is free from any discharge failure nozzle, the discharge failure complement data extraction timing generation unit 3-6-2 does not output any signal.

Based on the data, the discharge failure complement data extraction timing generation unit 3-6-2 notifies a discharge failure complement data extraction unit 3-6-3 of a timing at which discharge failure complement data (discharge failure complement data represents both discharge data of a discharge failure nozzle and printing data of a normal nozzle position subjected to discharge failure complement) is received. The discharge failure complement data extraction unit 3-6-3 is connected to a signal line for printing data output from the printing data generation unit 3-1-4. The discharge failure complement data extraction unit 3-6-3 can extract only discharge failure complement data from printing data in accordance with the timing notified by the discharge failure complement data extraction timing generation unit 3-6-2.

The extracted discharge failure complement data is transferred to a discharge failure complement algorithm execution unit 3-6-4. The discharge failure complement algorithm execution unit 3-6-4 is a block which performs discharge failure complement data calculation described in the principle.

According to the above-described principle, discharge failure complement data calculation requires discharge failure complement priority. Thus, a discharge failure complement priority setting unit 3-6-5 in the discharge failure complement block 3-6 transfers discharge failure complement priority data to the discharge failure complement algorithm execution unit 3-6-4. The discharge failure complement priority setting unit 3-6-5 has a function capable of setting discharge failure complement priority in accordance with setting by the CPU 3-4. By arranging the discharge failure complement priority setting unit 3-6-5, the discharge failure complement priority can be flexibly changed by firmware even after the ASIC E1102 is designed and manufactured.

The discharge failure complement algorithm execution unit 3-6-4 is an important function in the first embodiment, and will be described in detail with reference to the accompanying drawings.

Figure 4:
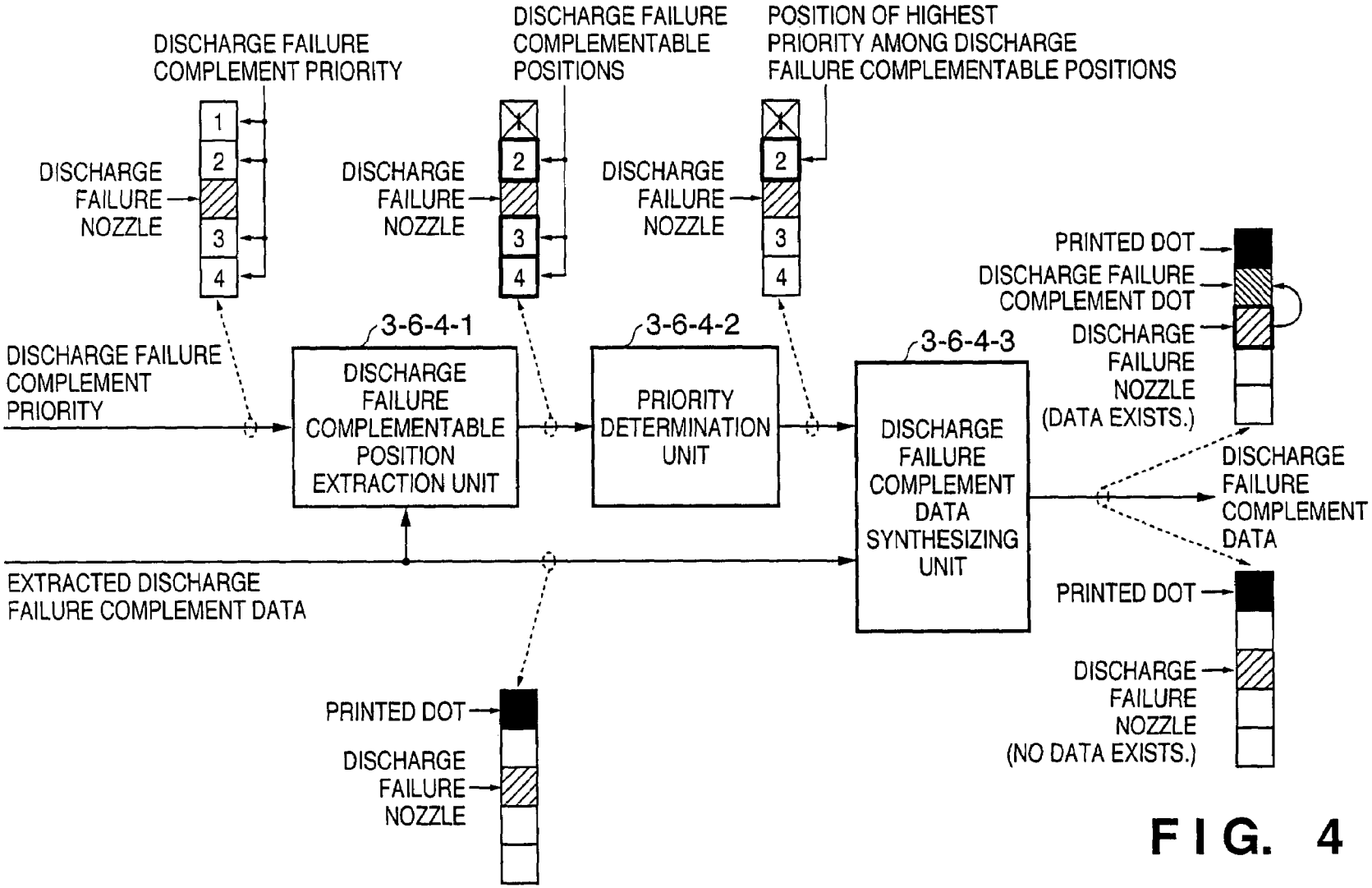
FIG. 4 is a view showing the configuration of a discharge failure complement algorithm execution unit in the discharge failure complement system according to the first embodiment.

FIG. 4 is a block diagram for explaining the configuration of the discharge failure complement algorithm execution unit 3-6-4 in more detail.

As described above, the discharge failure complement algorithm execution unit 3-6-4 receives discharge failure complement priority data, and extracted discharge failure complement data (discharge data of a discharge failure nozzle and printing data of a normal nozzle position subjected to discharge failure complement). Before a description, several assumptions will be made. As shown in FIG. 4, discharge failure complement is performed at two upper normal nozzle positions and two lower normal nozzle positions of a discharge failure nozzle, as described in the principle. Extracted discharge failure complement data at these positions are considered to have printing data at only the uppermost position as shown in FIG. 4 (whether printing data exists at the position of the discharge failure nozzle will be described later).

Discharge failure complement priorities are set at normal nozzle positions, i.e., four positions subjected to discharge failure complement. Assume that the priorities are set in order of (1), (2), (3), and (4) from the top, as shown in FIG. 4.

The building components of the discharge failure complement algorithm execution unit 3-6-4 and implementation of the algorithm will be described.

Two data, i.e., discharge failure complement priority data and extracted discharge failure complement data which are input to the discharge failure complement algorithm execution unit 3-6-4 are input to a discharge failure complementable position extraction unit 3-6-4-1. The purpose of this block is to extract, from the discharge failure complement priority data, only a priority at which no printing data by a normal nozzle exists and discharge failure complement can be done. In FIG. 4, printing data exists at a position of priority (1) in the discharge failure complement priority data, and priorities capable of discharge failure complement are (2), (3), and (4). The extracted priority data capable of discharge failure complement are transferred to a priority determination unit 3-6-4-2. This block decides only the highest priority among priorities capable of discharge failure complement. In FIG. 4, priorities capable of discharge failure complement are (2), (3), and (4), and the highest priority is (2).

At last, a discharge failure complement data synthesizing unit 3-6-4-3 executes a data process, completing discharge failure complement. The first function of this block is to synthesize data at the position of the highest priority output from the priority determination unit 3-6-4-2 and extracted discharge failure complement data serving as one of original input signals to the discharge failure complement algorithm execution unit 3-6-4, and create discharge failure-complemented printing data. The second function of this block is to determine whether printing data originally exists at the position of a discharge failure nozzle. If printing data exists at the position, discharge failure-complemented printing data is created, as described in the first function, and output as an output of the discharge failure complement algorithm execution unit 3-6-4. To the contrary, if no printing data exists at the position, the extracted discharge failure complement data is directly output as an output of the discharge failure complement algorithm execution unit 3-6-4.

The function and configuration of the discharge failure complement algorithm execution unit have been described. For reference, an algorithm part (=discharge failure complement algorithm itself) provided by the block can be formed by only a combinational circuit, and does not require any sequential circuit such as an FF which increases the gate amount. That is, the algorithm can be very simply implemented at low cost.

A subsequent internal function of the ASIC 1102 will be described again with reference to FIG. 3.

Discharge failure-complemented data as a product of the discharge failure complement algorithm execution unit 3-6-4 is written in a discharge failure complement data S-RAM 3-6-6. The discharge failure complement data S-RAM 3-6-6 corresponds to the printing data storage S-RAM 3-1-5 which stores printing data. The discharge failure-complemented data is final printing data, and may be stored in the printing data storage S-RAM 3-1-5. In this case, the number of write blocks to the printing data storage S-RAM 3-1-5 is two, i.e., the printing data generation unit 3-1-4 and discharge failure complement algorithm execution unit 3-6-4. Bus arbitration and conflict may occur and decrease the performance of the printer system. To prevent this, an S-RAM is arranged for only discharge failure-complemented data. However, when the performance of the printer system abruptly improves, the printing data storage S-RAM 3-1-5 may store discharge failure-complemented data.

The discharge failure-complemented data written in the discharge failure complement data S-RAM 3-6-6 is read out by the discharge failure complement data read unit 3-6-7 at a specified timing. The specified timing means that the discharge failure complement data read unit 3-6-7 is synchronized with the printing data read unit 3-1-6. More specifically, the printing data storage S-RAM 3-1-5 stores both printing data of a normal nozzle and printing data of a discharge failure nozzle. The discharge failure complement data S-RAM 3-6-6 stores only printing data of nozzles (two upper nozzles and two lower nozzles on the assumption of the first embodiment) around the discharge failure nozzle. The purpose of the first embodiment is to appropriately set data (printing data of nozzles around the discharge failure nozzle, i.e., discharge failure-complemented data) of the discharge failure complement data S-RAM 3-6-6 in data (printing data including both printing data of a normal nozzle and discharge failure nozzle) of the printing data storage S-RAM 3-1-5. While the printing data read unit 3-1-6 reads out data of a nozzle concerning discharge failure complement, corresponding data is also read out from the discharge failure complement data S-RAM 3-6-6. These two data must be properly set (it is also possible to form a sequential circuit which reads out these two data at different timings and properly sets these two data later. In this case, the sequential circuit increases in scale, and is not a desirable means in terms of providing a simple, small-scale system at low cost). For this reason, the discharge failure complement data read unit 3-6-7 must read out discharge failure-complemented data on the basis of a signal from the printing data read unit 3-1-6 in synchronism with the signal. The printing data read unit 3-1-6 determines whether printing data currently read out by the unit 3-1-6 concerns discharge failure complement, and then outputs a signal to the discharge failure complement data read unit 3-6-7. Thus, the printing data read unit 3-1-6 requires discharge failure nozzle information output from the discharge failure information storage unit 3-6-1.

Discharge failure-complemented data which is read out by the discharge failure complement data read unit 3-6-7 is transferred to the discharge failure-complemented data generation unit 3-6-8 together with printing data (according to the above procedures, this printing data must be data of a nozzle position associated with discharge failure complement) synchronously read out by the printing data read unit 3-1-6. The data generation unit 3-6-8 sets the discharge failure-complemented data in the printing data.

Figure 5:
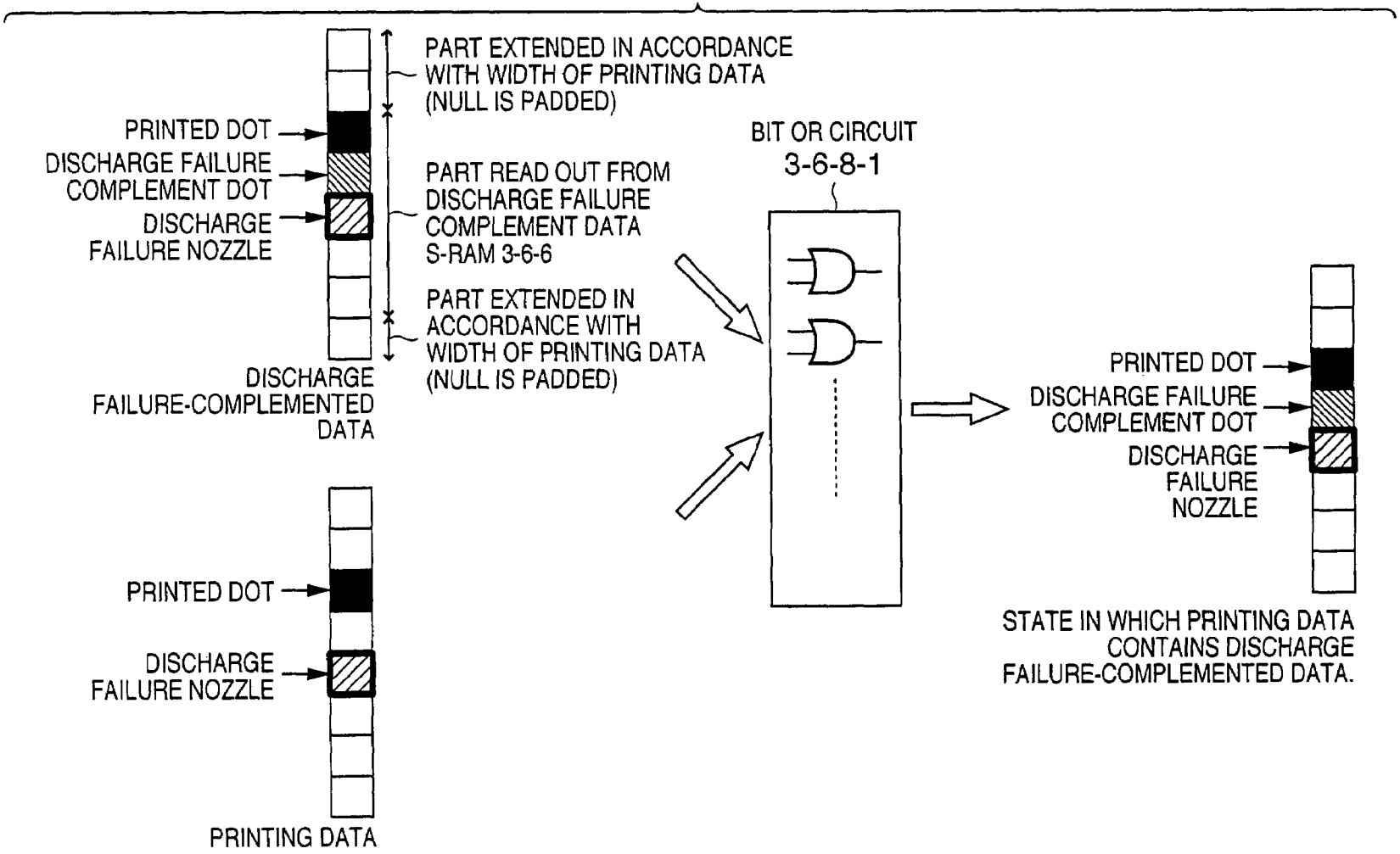
FIG. 5 is a view showing the configuration of a discharge failure-complemented data generation unit in the discharge failure complement system according to the first embodiment.

FIG. 5 shows this state.

This process will be briefly explained. As described above, discharge failure-complemented data and printing data are input. The discharge failure-complemented data is extended to the same number of bits as that of printing data. In a general printer, printing data is processed for a multiple of eight such as bytes or words. However, discharge failure-complemented data may have a smaller number of bits (in the first embodiment, a total number of bits are five: one bit for a discharge failure nozzle, and four bits for nozzles subjected to discharge failure complement (because of two upper nozzles and two lower nozzles of the discharge failure nozzle)). In this case, the number of bits of discharge failure-complemented data must be adjusted to that of printing data. The first embodiment assumes that printing data is processed every eight bits (=one byte), as shown in FIG. 5. Discharge failure-complemented data must be extended from five bits to eight bits. The extension method simply decides positions to be extended on the basis of discharge failure nozzle position information transferred from the discharge failure information storage unit 3-6-1, and pads "0"s (NULL data) at positions to be extended. The printing data and the bit-extended data having undergone discharge failure complement are transferred to a bit OR circuit 3-6-8-1. The bits are ORed, and the calculation result is output as an output of the discharge failure-complemented data generation unit 3-6-8.

Referring to FIG. 5, discharge failure-complemented data (bit-extended data) which is an input to the discharge failure-complemented data generation unit 3-6-8 is identical to printing data containing the discharge failure-complemented data serving as an output from the discharge failure-complemented data generation unit 3-6-8. The bit OR circuit 3-6-8-1 is not necessary in this case, but is necessary in some cases. The first embodiment assumes that nozzle printing data adjacent in the same 1-byte printing data are adjacent to each other similarly to nozzles of the printhead 3-3 (similar to the printhead 2-1 and nozzle array 2-2 shown in FIG. 2). However, in some printer systems, adjacent nozzle printing data may exist in different 1-byte printing data. This is based on the difference in printhead form or driving method, and printing data does not always have the format shown in FIG. 5. For this reason, it is necessary to process discharge failure-complemented data (extract necessary bits) and extend the data (pad "0"s in accordance with the bit width of the printing data) in accordance with the printing data format. In this case, the timing and the position at which data of a nozzle concerning discharge failure complement appears in printing data change. The printing data read unit 3-1-6 and discharge failure complement data read unit 3-6-7 must operate in cooperation with each other in accordance with the change.

Printing data containing the generated discharge failure complement data is transferred to the printhead control unit 3-1-7. The printhead control unit 3-1-7 prints in accordance with the protocol of the printhead 3-3. This process is the same as that in the absence of any discharge failure.

(3) Effects of First Embodiment

As described above, the first embodiment solves all the above problems and can complement a discharge failure nozzle. More specifically, the discharge failure complement process engine is implemented by a very simple arrangement at lost cost. Since the discharge failure complement process is executed within the same printing pass as that in which data assigned to the discharge failure nozzle is printed, no printing pass for only discharge failure complement exists. The discharge failure complement process is completed within a single nozzle array. Even if another discharge failure occurs in another nozzle array, i.e., a nozzle array of a different color, the discharge failure complement process can be done by the same process algorithm every time printing data of the discharge failure nozzle in the nozzle array is created. In this way, the first embodiment solves the problems.

Second Embodiment (1) Further Improvement in First Embodiment

The first embodiment solves the conventional drawbacks. Compared to the first embodiment, the second embodiment implements discharge failure complement while increasing the service life of the printhead.

For example, in the first embodiment, the use frequency of a nozzle of a higher priority rises in discharge failure complement. As a result, the service life of the nozzle of a higher priority becomes shorter than that of another normal nozzle.

The second embodiment solves this problem, and provides a more preferable discharge failure complement method and discharge failure complement algorithm.

(2) Principle

A principle necessary to implement the second embodiment will be explained first.

Figure 6:
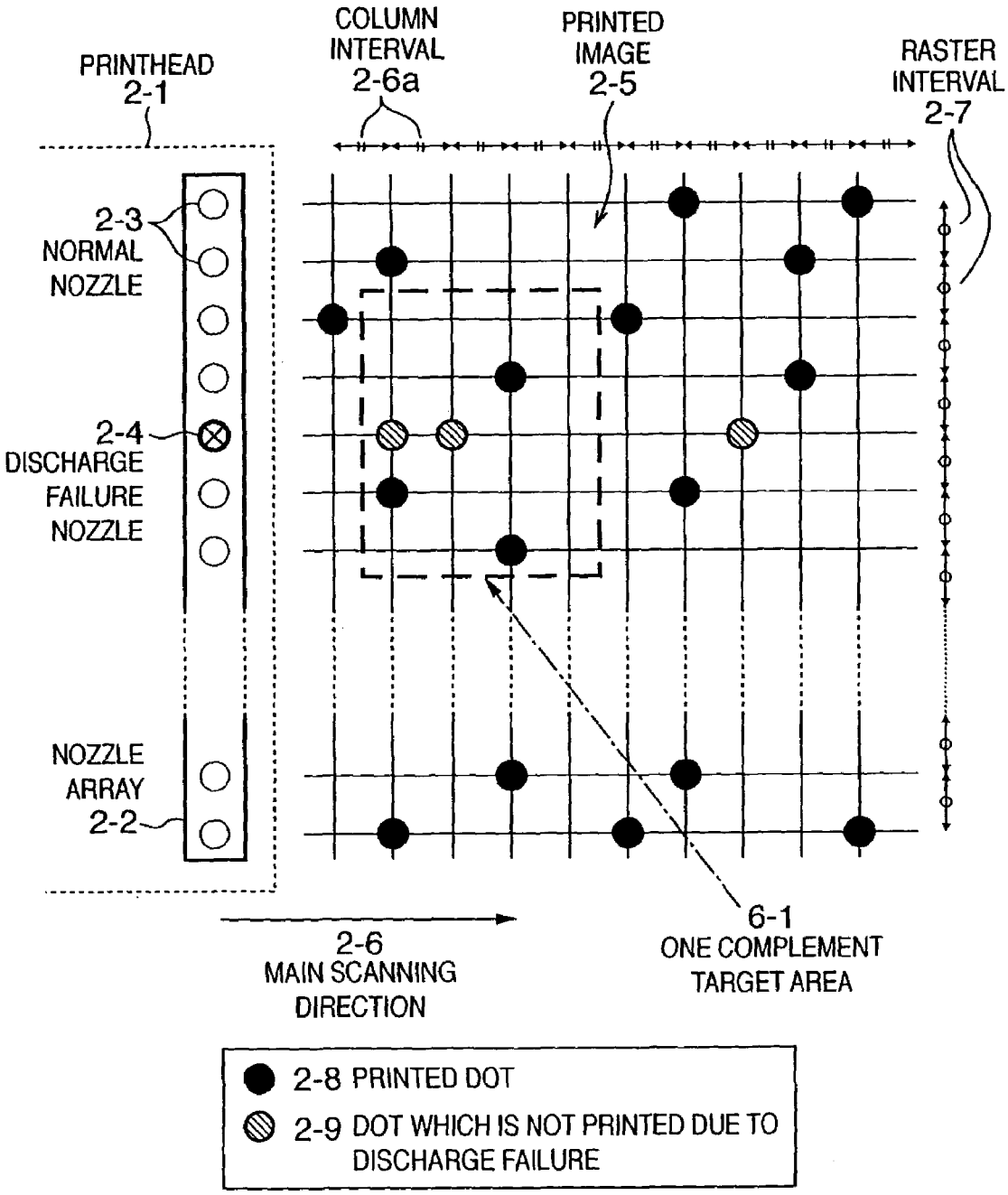
FIG. 6 is a complementary view for explaining the principle of discharge failure complement according to the second embodiment.

FIG. 6 is a view schematically showing a printing state in the presence of a discharge failure nozzle. The contents shown in FIG. 6 are almost the same as those shown in FIG. 2 except that the complement target area is one column x five rasters in FIG. 2 and four columns x five rasters (=complement target area 6-1) in FIG. 6.

A state in which a discharge failure dot within the area 6-1 is complemented will be explained by using only the area 6-1.

FIGS. 7A to 7D are views most simply expressing the principle of discharge failure complement according to the second embodiment.

Figure 7A:
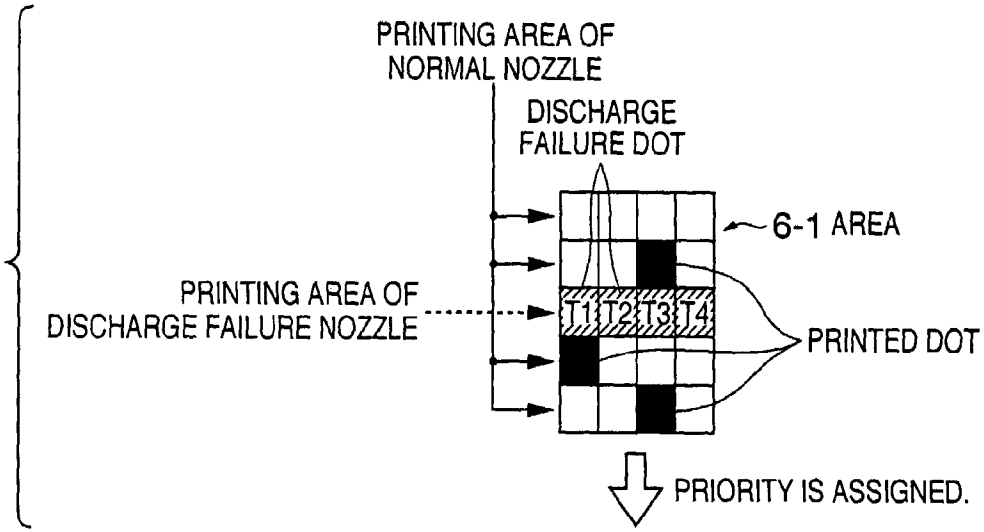
FIGS. 7A to 7D are views for explaining the principle of discharge failure complement according to the second embodiment.

FIG. 7A is a view showing one extracted complement target area 6-1 in FIG. 6. The complement target area 6-1 contains three printed dots and four dots which have not been printed due to a discharge failure. For descriptive convenience, the positions of discharge failure dots on respective columns will be called T1, T2, T3, and T4 from the left dot (T means the initial letter "T" of a target for discharge failure complement).

Figure 7B:
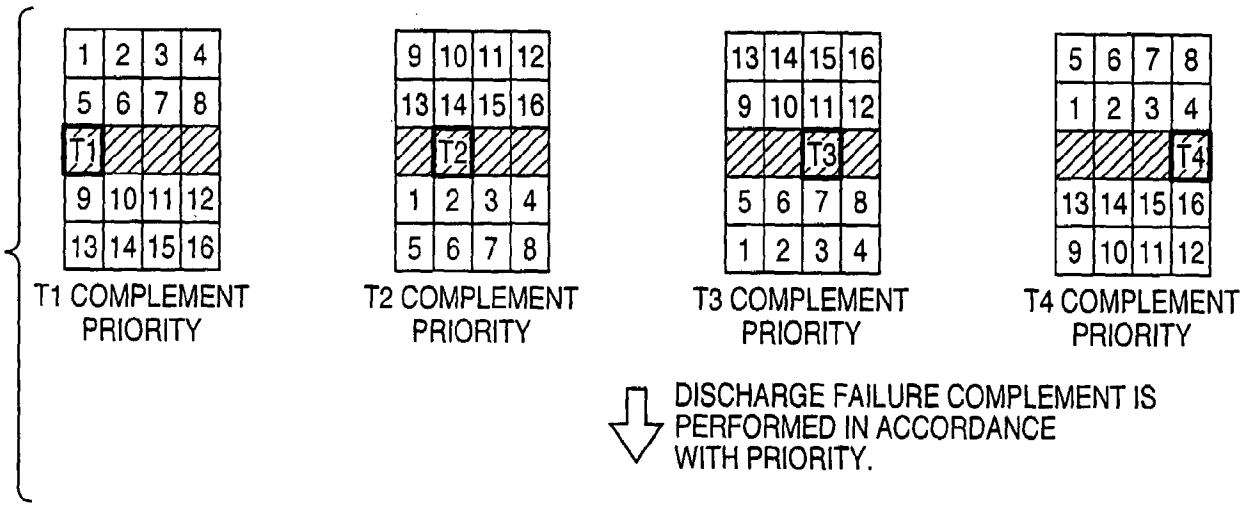

FIG. 7B shows states in which priorities for complementing discharge failure dots are assigned to dot positions at which not a discharge failure nozzle but a normal printing nozzle exists and can print, other than the positions of discharge failure dots, in order to complement discharge failure dots shown in FIG. 7A. In this stage, priority numbers are assigned regardless of whether a dot to be printed exists at a dot position to be assigned a priority. This process also corresponds to the description of FIG. 1B except that different priorities are assigned to discharge failure dots T1, T2, T3, and T4. In addition, since the number of positions subjected to discharge failure complement increases from four to 16, priorities (1) to (16) are assigned in FIG. 7B, instead of priorities (1) to (4) in FIG. 1B. These priorities may be assigned to T1, T2, T3, and T4 by the same pattern. However, to achieve the purpose of the second embodiment, the priorities are desirably assigned by different patterns, as shown in FIG. 7B.

Figure 7C:
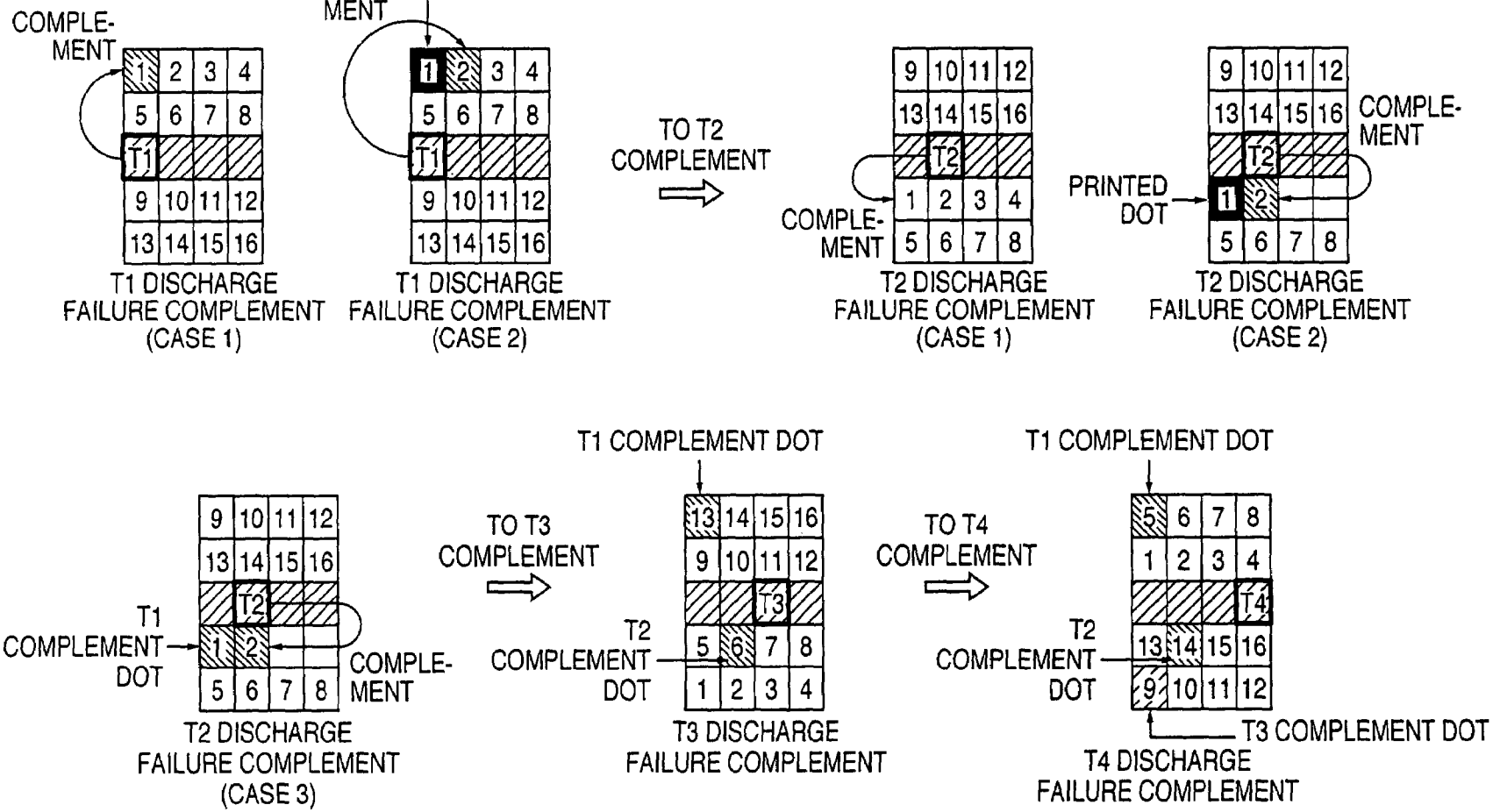

FIG. 7C shows states in which discharge failure dots are complemented in accordance with the discharge failure complement priorities assigned as shown in FIG. 7B. In FIG. 7C, the pattern of printed dots in the area 6-1 is not fixed, unlike FIG. 7A. FIG. 7C illustrates how to perform discharge failure complement for T1, T2, T3, and T4 in some cases.

A case in which a printed dot exists at the position of discharge failure dot T1 will be explained. T1 discharge failure complement (case 1) is an example of this case. In case 1, no printed dot and one dot which has not been printed due to a discharge failure exist. In this case, the dot which has not been printed due to a discharge failure directly shifts to a position of the highest discharge failure complement priority (i.e., dot complement is executed). In case 1, this position is a dot position having discharge failure complement priority (1).

Another example of T1 discharge failure complement (case 2) will be examined. In case 2, one printed dot and one dot which has not been printed due to a discharge failure exist. The printed dot exists at a position having discharge failure complement priority (1). In this case, the dot which has not been printed due to a discharge failure shifts to a position of the highest discharge failure complement priority except discharge failure complement priority (1). In case 2, this position is a dot position having discharge failure complement priority (2) in FIG. 7C.

A case in which a printed dot exists at the position of discharge failure dot T2 will be described. Assume that the T2 discharge failure complement process must be performed after the end of the T1 process. T2 discharge failure complement (case 1) is an example of this case. In case 1, no printed dot and one dot which has not been printed due to a discharge failure exist. In this case, the dot which has not been printed due to a discharge failure is directly complemented at a position of the highest discharge failure complement priority. In case 1, this position is a dot position having discharge failure complement priority (1).

Another example of T2 discharge failure complement (case 2) will be examined. In case 2, one printed dot and one dot which has not been printed due to a discharge failure exist. In this case, the printed dot exists at a position having discharge failure complement priority (1). In this case, the dot which has not been printed due to a discharge failure shifts to a position of the highest discharge failure complement priority except discharge failure complement priority (1). In case 2, this position is a dot position having discharge failure complement priority (2) in FIG. 7C.

Still another example of T2 discharge failure complement (case 3) will be examined. In case 3, no printed dot and one complement dot (assumed to have been generated in the T1 process preceding to the T2 process) exist. The complement dot exists at a position having discharge failure complement priority (1). In this case, the dot (T2) which has not been printed due to a discharge failure shifts to a position of the highest discharge failure complement priority except discharge failure complement priority (1). In case 3, this position is a dot position having discharge failure complement priority (2) in FIG. 7C.

The discharge failure complement process is executed in order of T1→T2, and then the process is executed by the same algorithm in order of T3→T4.

This will be explained briefly. In T3 discharge failure complement of FIG. 7C, if a printed dot exists at the position of discharge failure dot T3, the complement process is done using a dot except complement dots formed at T1 and T2 and original printed dots. In T3 discharge failure complement, complement is performed at a position having discharge failure complement priority (1). If no printed dot exists at the position of discharge failure dot T3, no process is done.

Also in T4 discharge failure complement of FIG. 7C, if a printed dot exists at the position of discharge failure dot T4, the complement process is done using a dot except complement dots formed at T1, T2, and T3 and original printed dots. In T4 discharge failure complement, complement is performed at a position having discharge failure complement priority (1). If no printed dot exists at the position of discharge failure dot T4, no process is done.

Figure 7D:
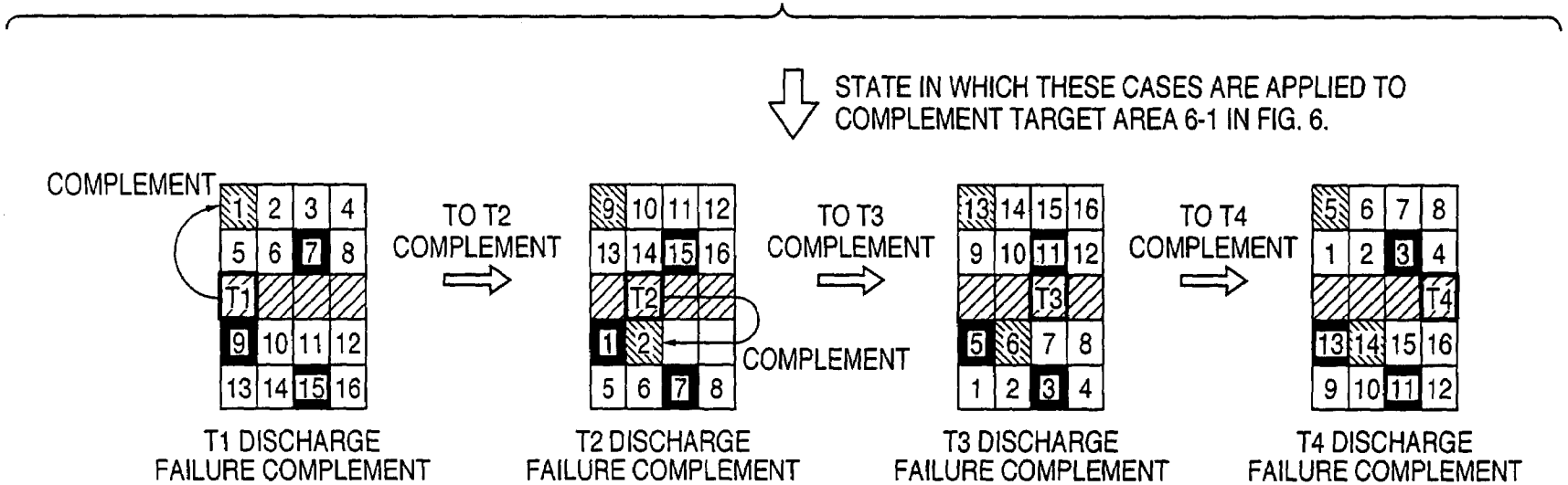

FIG. 7D shows states in which this algorithm is applied to execute discharge failure complement in the example of FIG. 7A. FIG. 7D assumes that discharge failure complement priorities for discharge failure dots are assigned in the order of FIG. 7B before complement. T1 discharge failure complement of FIG. 7D illustrates a state in which T1 discharge failure complement is done. A printed dot exists at the position of discharge failure dot T1, and no printed dot exists at a position of discharge failure complement priority (1). Thus, discharge failure dot T1 is moved to the position of discharge failure complement priority (1).

The T2 process is executed next, and this state is illustrated in T2 discharge failure complement of FIG. 7D. A printed dot exists at the position of discharge failure dot T2, and a printed dot exists at the position of discharge failure complement priority (1). The second highest discharge failure complement priority is searched for to detect that a position having discharge failure complement priority (2) is blank. Thus, discharge failure dot T2 is moved to the position of discharge failure complement priority (2).

The T3 process is executed next, and this state is illustrated in T3 discharge failure complement of FIG. 7D. In this case, no printed dot exists at the position of discharge failure dot T3, and no complement process is performed.

The T4 process is executed next, and this state is illustrated in T4 discharge failure complement of FIG. 7D. In this case, no printed dot exists at the position of discharge failure dot T4, and no complement process is performed.

The features of the principle necessary to implement the second embodiment will be briefly summarized.

In the first embodiment, when the printhead includes a discharge failure nozzle and data to be printed exists at the position of the discharge failure nozzle, dots to be printed are moved to upper and lower normally printable nozzles around the discharge failure nozzle (in the first embodiment, the normally printable nozzles are assumed to be two upper nozzles and two lower nozzles of the discharge failure nozzle). In the second embodiment, the complement area is widened, and the dots of the discharge failure nozzle are complemented within an area of several columns (assumed to be four columns in the principle). Further, discharge failure complement priorities can be set for discharge failure dots present in respective columns.

The principle necessary to implement the second embodiment has been described.

(3) Arrangement and Data Flow

An arrangement necessary to implement the second embodiment and the data flow will be explained.

The basic operation is almost the same as that in the first embodiment, and only a difference will be explained.

Similar to the first embodiment, the second embodiment requires the building components of the printer, i.e., components shown in FIGS. 11 and 12.

Also similar to the first embodiment, the second embodiment requires the internal building components of an ASIC E1102, i.e., components shown in FIG. 3. In addition to them, the second embodiment adopts a discharge failure complement priority setting unit 3-6-5 which holds data of a form different from discharge failure complement priority data in the first embodiment. The difference in discharge failure complement priority data is the difference between discharge failure complement priority shown in FIGS. 1A to 1D and discharge failure complement priority shown in FIGS. 7A to 7D.

Another difference is the process of a discharge failure complement algorithm execution unit 3-6-4. This part is essential to the second embodiment, and will be explained with reference to another drawing.

Figure 8:
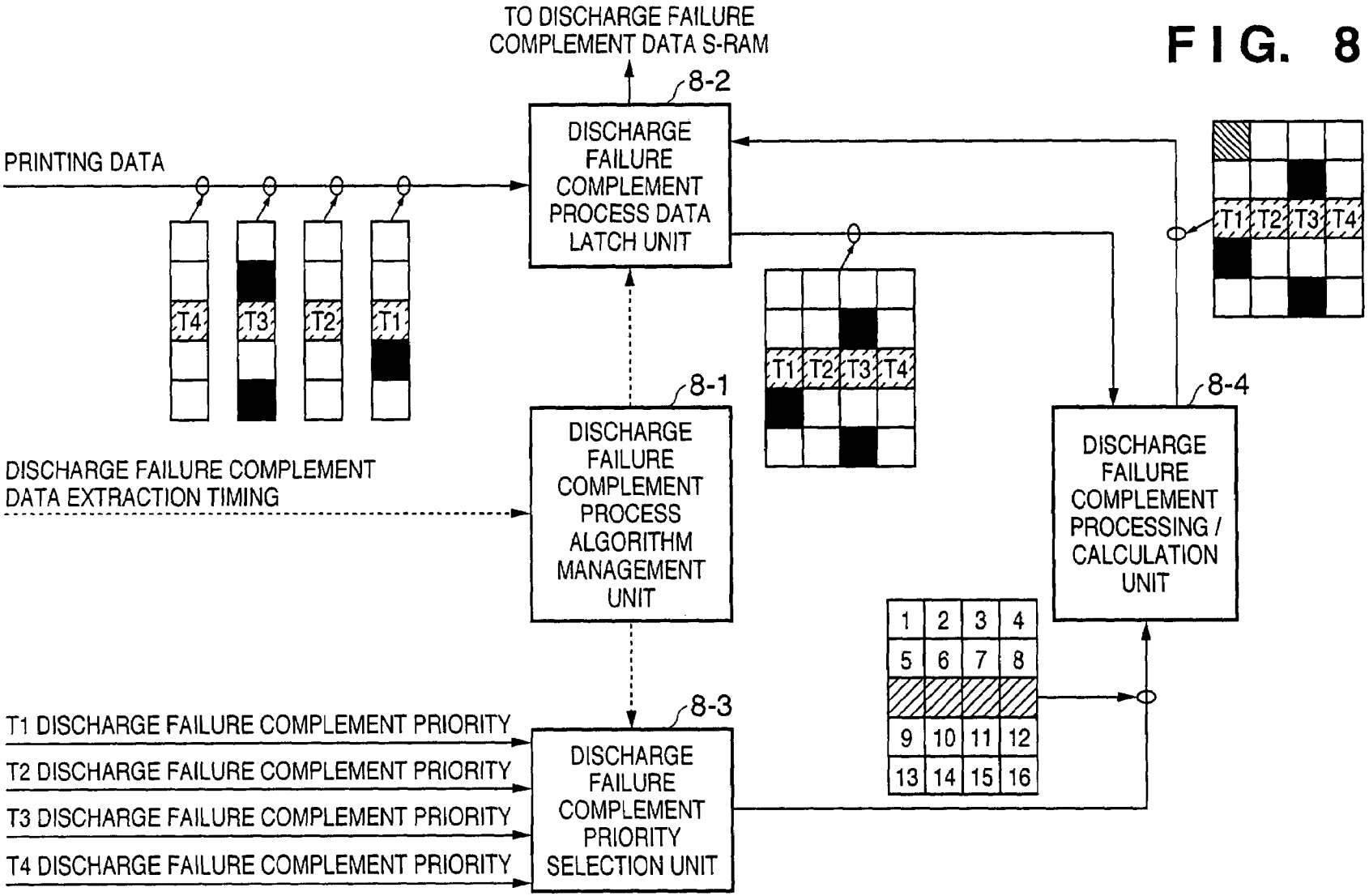
FIG. 8 is a view showing the configuration of a discharge failure complement algorithm execution unit in a discharge failure complement system according to the second embodiment.

FIG. 8 shows the discharge failure complement algorithm execution unit 3-6-4.

Respective components and the data flow between them will be explained. Before a description, the following settings must be done for discharge failure complement of the second embodiment. As shown in FIG. 8, discharge failure complement is performed in a range defined by two upper normal nozzle positions and two lower normal nozzle positions of a discharge failure nozzle and four columns, as described in the principle. The discharge failure process is executed in order of T1→T2→T3→T4, as described in the principle.

The discharge failure complement algorithm execution unit 3-6-4 receives a signal from a discharge failure complement data extraction timing generation unit 3-6-2, and receives discharge failure complement data. Unlike the first embodiment, after discharge failure complement data are received by a range of four columns, sequential control to perform calculation for the respective columns is necessary. This control requires a discharge failure complement algorithm management unit 8-1 which controls the overall operation. This block receives a signal from the discharge failure complement data extraction timing generation unit 3-6-2, and outputs a signal on the basis of the received signal so as to cause a discharge failure complement data latch unit 8-2 to latch discharge failure complement data. After discharge failure complement data of four columns are latched, the discharge failure complement algorithm management unit 8-1 starts the discharge failure complement process.

The latched discharge failure complement data (as is apparent from FIG. 8, data has a bit width of 20 bits in the second embodiment) is always output from the discharge failure complement data latch unit 8-2 to a discharge failure complement process calculation unit 8-4 regardless of the operation clock. As for discharge failure complement priority data, as shown in FIG. 8, four data patterns are transferred from the discharge failure complement priority setting unit 3-6-5 for conversion at T1 to T4. Discharge failure complement priority data must be appropriately selected in accordance with the position of the current discharge failure dot during conversion. For this reason, the discharge failure complement algorithm management unit 8-1 processes a discharge failure dot at position T1, and transfers a signal to a discharge failure complement priority selection unit 8-3 so as to output discharge failure complement priority data for processing T1.

The discharge failure complement data of four columns output from the discharge failure complement data latch unit 8-2 and the discharge failure complement priority data for processing T1 that is output from the discharge failure complement priority selection unit 8-3 are input to a discharge failure complement processing/calculation unit 8-4.

Figure 9:
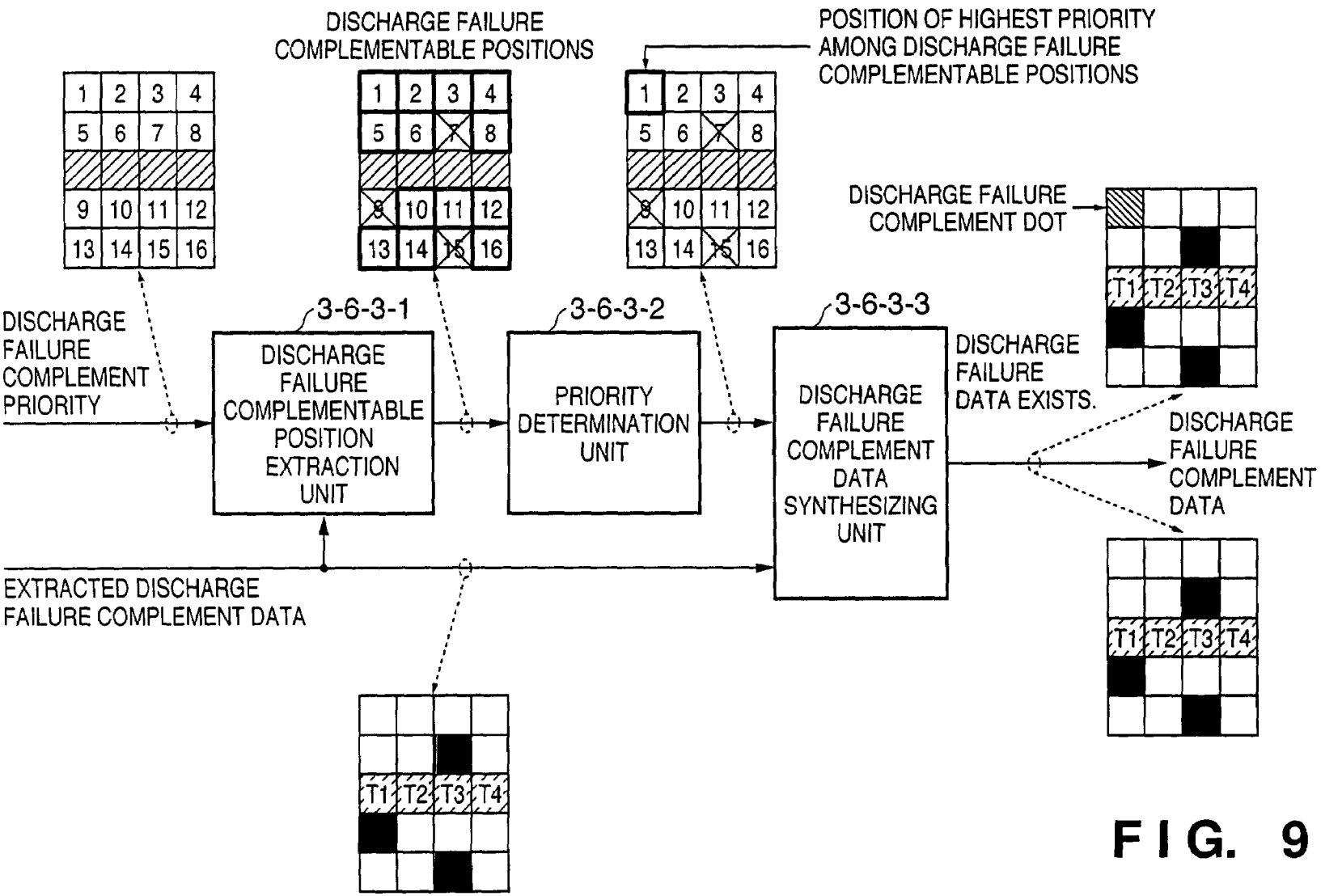
FIG. 9 is a view showing the configuration of a discharge failure complement processing/calculation unit in the discharge failure complement system according to the second embodiment.

The function of the discharge failure complement processing/calculation unit 8-4 is almost the same as that of the discharge failure complement algorithm execution unit 3-6-4 in the first embodiment. This is apparent from FIG. 9 which shows the function and is similar to FIG. 4. The function is different from that of FIG. 4 in the first embodiment in that the conversion unit of discharge failure complement is five bits in the first embodiment and 20 bits in the second embodiment. The remaining process is the same as that in FIG. 4. That is, a discharge failure complementable position extraction unit 3-6-4-1 determines discharge failure complementable positions from discharge failure complement data and discharge failure complement priority data for processing T1. A priority determination unit determines a position of the highest priority among the discharge failure complementable positions. At last, a discharge failure complement data synthesizing unit performs discharge failure complement on the basis of the discharge failure complement data and the position of the highest priority among the discharge failure complementable positions. If printing data exists at the position of discharge failure dot T1, the printing data is moved to a position of the highest priority among discharge failure complementable positions. If no printing data exists at the position of discharge failure dot T1, input printing data is directly output. Discharge failure complement is executed in accordance with this flow.

It is important that the function of the discharge failure complement processing/calculation unit 8-4 can be formed by only a combinational circuit, as described in the first embodiment. Simultaneously when discharge failure complement data of four columns and discharge failure complement priority data for processing T1 are input, discharge failure-complemented data is logically output (regardless of whether printing data exists at T1). In practice, however, a given gate delay may be posed between input and output. Thus, the discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, data output from the discharge failure complement processing/calculation unit 8-4. The number of clocks for waiting suffices to be about two, and the management unit 8-1 to be described in the second embodiment waits until two clocks are input. The discharge failure complement process data latch unit 8-2 which latches the new discharge failure complement data of four columns having undergone discharge failure complement for printed dot T1 outputs the data to the discharge failure complement processing/calculation unit 8-4 again.

In order to process a discharge failure dot at position T2, the discharge failure complement algorithm management unit 8-1 transfers a signal to the discharge failure complement priority selection unit 8-3 so as to output discharge failure complement priority data for processing T2. The discharge failure complement processing/calculation unit 8-4 receives the discharge failure complement data of four columns having undergone discharge failure complement for printed dot T1, and the discharge failure complement priority data for processing T2. The discharge failure complement processing/calculation unit 8-4 outputs the discharge failure complement data of four columns having undergone discharge failure complement for printed dots T1 and T2 after a proper gate delay in accordance with the above-described procedures. The discharge failure complement algorithm management unit 8-1 waits until proper operation clocks (as described above, two clocks in the second embodiment) are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 and T2 outputs the data to the discharge failure complement processing/calculation unit 8-4 again.

In order to process a discharge failure dot at position T3, the discharge failure complement algorithm management unit 8-1 transfers a signal to the discharge failure complement priority selection unit 8-3 so as to output discharge failure complement priority data for processing T3. The discharge failure complement processing/calculation unit 8-4 receives the discharge failure complement data of four columns having undergone discharge failure complement for printed dots T1 and T2, and the discharge failure complement priority data for processing T3. The discharge failure complement processing/calculation unit 8-4 outputs the discharge failure complement data of four columns having undergone discharge failure complement for printed dots T1 to T3 after a proper gate delay in accordance with the above-described procedures. The discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 to T3 outputs the data to the discharge failure complement processing/calculation unit 8-4 again.

In order to process a discharge failure dot at position T4, the discharge failure complement algorithm management unit 8-1 transfers a signal to the discharge failure complement priority selection unit 8-3 so as to output discharge failure complement priority data for processing T4. The discharge failure complement processing/calculation unit 8-4 receives the discharge failure complement data of four columns having undergone discharge failure complement for printed dots T1 to T3, and the discharge failure complement priority data for processing T4. The discharge failure complement processing/calculation unit 8-4 outputs the discharge failure complement data of four columns having undergone discharge failure complement for printed dots T1 to T4 after a proper gate delay in accordance with the above-described procedures. The discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 to T4 transfers the data, i.e., the discharge failure complement data of four columns having undergone discharge failure complement to a discharge failure complement data S-RAM 3-6-6. The discharge failure complement process for discharge failure complement of four columns ends.

This process is repeated every time discharge failure complement printing data of four columns are received.

(4) Effects of Second Embodiment

As described above, the second embodiment solves all the problems described in the second embodiment, and can complement a discharge failure nozzle. More specifically, when the printhead includes a discharge failure nozzle and data to be printed exists at the position of the discharge failure nozzle, the second embodiment widens the complement area and executes complement within an area of several columns. Further, discharge failure complement priorities can be set for discharge failure dots present in respective columns. Since the discharge failure complement priority changes every four columns, the position of a nozzle having a high discharge failure complement priority also changes every four columns. The principle of discharge failure complement can be employed without any burden on a specific nozzle.

Third Embodiment (1) Improvement in First and Second Embodiments

The first and second embodiments solve the conventional drawbacks and other problems. However, the method of complementing an unprinted position due to a discharge failure so as not to stand out is an advanced function, and may pose another problem.

In the first and second embodiments, complement priority data is indispensable for discharge failure complement. According to this proposal, the first and second embodiments can perform the complement process even if discharge failure nozzles exist at different positions in nozzles of all colors in the printhead. For example, when the printhead of the printer copes with inks of seven colors, seven sets of complement priority data are necessary. Implementation of these sets by a hardware mechanism (e.g., by writable/readable registers) greatly increases the number of gates in the ASIC. The number of ink colors of one printer is predicted to increase in the future, and the impact on hardware also increases.

The number of necessary priority data can be decreased by using the same priority data for inks of all colors. However, the influence of a discharge failure nozzle on an image changes depending on the ink color. The system is preferably equipped with different priority data for respective ink colors so as to tune discharge failure complement by firmware.

The third embodiment solves these problems, and provides a discharge failure complement method and discharge failure complement algorithm which are more preferable in hardware packaging.

(2) Arrangement and Data Flow

Figure 10:
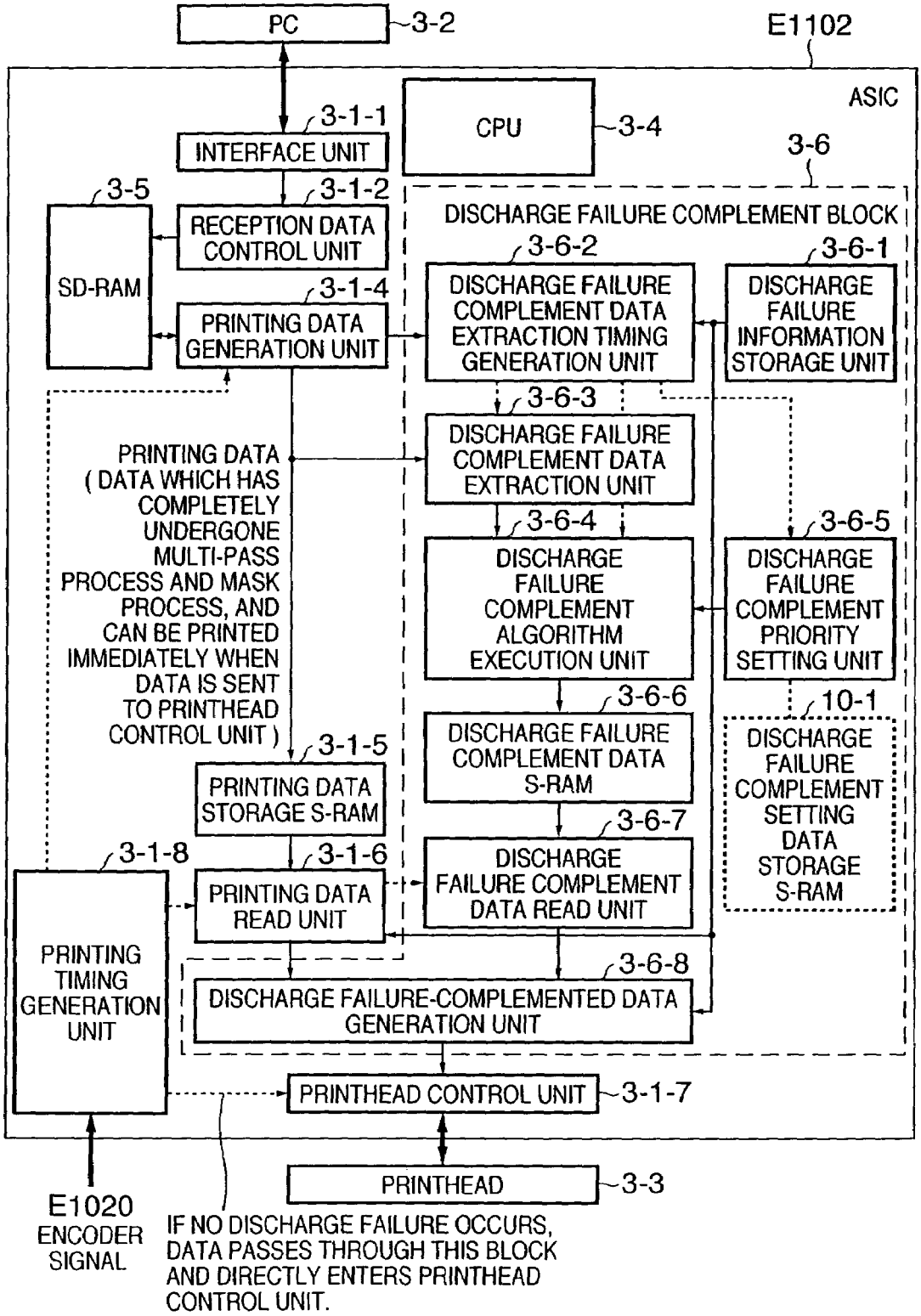
FIG. 10 is a block diagram showing the configuration of a discharge failure complement system according to the third embodiment.

FIG. 10 is a block diagram showing the configuration of a system according to the third embodiment.

As is apparent from FIG. 10, the configuration in the third embodiment is almost the same as those in the first and second embodiments except for the presence of a discharge failure complement setting data storage S-RAM 10-1.

The first and second embodiments do not consider strict specifications of a discharge failure complement priority setting unit 3-6-5, whereas the third embodiment clearly defines them. In the third embodiment, the discharge failure complement priority setting unit 3-6-5 comprises only a hardware configuration (=register set) necessary to perform discharge failure complement for one nozzle array on which a plurality of nozzles corresponding to one of colors are arrayed.

Instead, the discharge failure complement setting data storage S-RAM 10-1 stores discharge failure complement priority data corresponding to nozzle arrays of respective colors. The discharge failure complement priority setting unit 3-6-5 receives a signal from a discharge failure complement data extraction timing generation unit 3-6-2, and reads out necessary discharge failure complement priority data from the discharge failure complement setting data storage S-RAM 10-1

(this data must be set by a CPU 3-4 in advance). The readout data is set in the internal register set of the discharge failure complement priority setting unit 3-6-5.

In other words, the discharge failure complement data extraction timing generation unit 3-6-2 and discharge failure complement priority setting unit 3-6-5 must function as follows. The discharge failure complement data extraction timing generation unit 3-6-2 receives information from a discharge failure information storage unit 3-6-1, and specifies a position from which discharge failure complement data is extracted. At this time, the discharge failure complement data extraction timing generation unit 3-6-2 must recognize for which of colors of printing data the discharge failure complement data extraction timing generation unit observes whether to extract discharge failure complement data (otherwise, printing data around discharge failure nozzles present at different positions in nozzle arrays of respective color inks cannot be extracted). In outputting an extraction timing signal, the discharge failure complement data extraction timing generation unit 3-6-2 can notify the discharge failure complement priority setting unit 3-6-5 by the signal of the start of the discharge failure complement process and which of color nozzle arrays is subjected to discharge failure complement. By using the signal notification as a trigger, the discharge failure complement priority setting unit 3-6-5 reads out the discharge failure complement priority of a color nozzle array in process from the discharge failure complement setting data storage S-RAM 10-1.

With this arrangement, the discharge failure complement setting data storage S-RAM 10-1 stores discharge failure complement priority data by the number of color nozzle arrays. The discharge failure complement priority setting unit 3-6-5 can tune discharge failure complement for respective colors by arranging only a discharge failure complement register set for one nozzle array. The image quality can be maintained with a small hardware configuration.

In this case, the discharge failure complement setting data storage S-RAM 10-1 is newly added. The discharge failure complement setting data storage S-RAM 10-1 and discharge failure complement data S-RAM 3-6-6 can use the same S-RAM. An area where discharge failure complement setting data is stored and an area where discharge failure complement data is stored can be set in the same S-RAM by using different address spaces. Even if two different types of data are stored in the same S-RAM, the contents of the discharge failure complement setting data storage S-RAM 10-1 is read out before the discharge failure complement process, and data is written in the discharge failure complement data S-RAM 3-6-6 after the discharge failure complement process. Thus, read access and write access do not simultaneously occur, and the system process performance does not decrease even with a small hardware configuration.

Since the same S-RAM plays two roles, i.e., the discharge failure complement setting data storage S-RAM 10-1 and discharge failure complement data S-RAM 3-6-6, the S-RAM capacity increases. However, the hardware configuration can be simplified and reduced in comparison with the arrangement of register sets by the number of color nozzle arrays.

(3) Effects of Third Embodiment

As described above, the third embodiment adopts the discharge failure complement setting data storage S-RAM 10-1 in which setting data necessary for discharge failure complement is stored and read out, as needed. This can completely prevent an increase in hardware and the adverse effect to an image.

Fourth Embodiment (1) Principle

A principle necessary to implement the fourth embodiment will be explained first.

In "BACKGROUND OF THE INVENTION", when the printhead comprises 512 nozzles per nozzle array and the first nozzle of the head is a discharge failure nozzle, the discharge failure nozzle can be complemented by only a nozzle such as the second or third nozzle in a direction in which the nozzle number increases. This is because the printhead does not have any 0th or −1st nozzle and the discharge failure nozzle cannot be complemented by such nozzle.

The gist of the fourth embodiment is to form a nozzle such as the 0th, −1st, 513th, or 514th nozzle which does not exist in a general nozzle array image.

Figure 14:
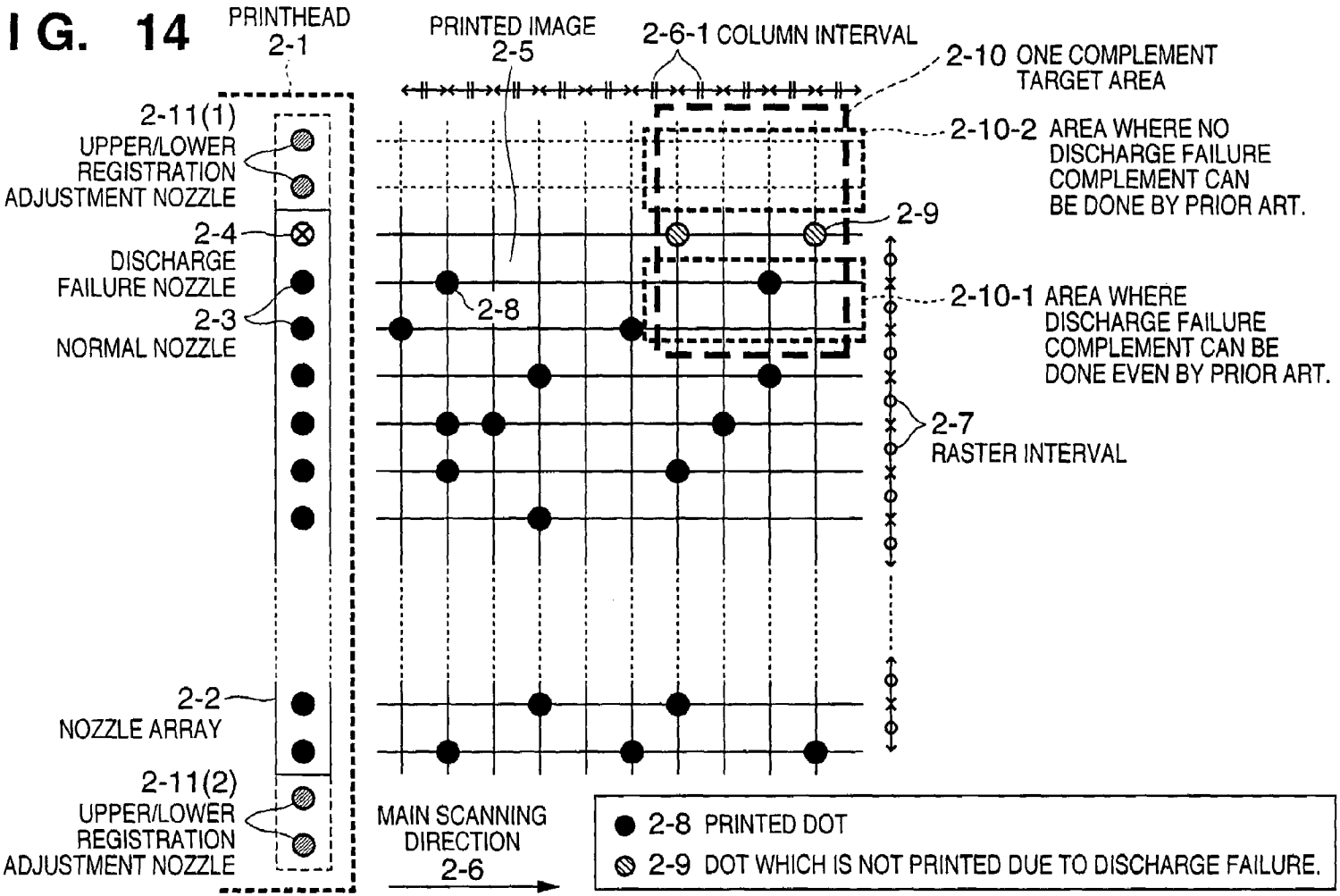
FIG. 14 is a complementary view for explaining the principle of discharge failure complement according to the fourth embodiment.

FIG. 14 is a view schematically showing a printing state in the presence of a discharge failure nozzle.

FIG. 14 illustrates a specific nozzle array 2-2 extracted from a printhead 2-1. This nozzle array includes (many) normal nozzles 2-3 and a discharge failure nozzle 2-4 (only one discharge failure nozzle exists in the nozzle array 2-2), as shown in FIG. 14. Reference numeral 2-5 denotes a printed image which is formed on the sheet surface by the nozzle array 2-2 of the printhead 2-1. Assume that the printhead 2-1 prints the printed image 2-5 while moving in a main scanning direction 2-6. At this time, the discharge timing of the head is electrically determined, and the nozzle array 2-2 of the printhead 2-1 forms the printed image 2-5 while maintaining a specified interval=a column interval 2-6-1 in the scanning direction 2-6 and a specified interval a raster interval 2-7 (which complies with the mechanical nozzle interval of the nozzle array 2-2 in many cases) in a direction perpendicular to the main scanning direction. The printed image 2-5 shown in FIG. 14 is an image printed when the printhead 2-1 scans once in the main scanning direction 2-6. In other words, the printed image 2-5 is not a printed image upon the completion of multi-pass printing.

In this case, the normal nozzle 2-3 discharges ink to a print dot position 2-8 in the printed image 2-5. The discharge failure nozzle 2-4 should originally discharge ink to a print dot position 2-9, but does not discharge any ink to this position.

The purpose of the fourth embodiment is to make the print dot position 2-9 look as if a dot were printed at this position.

Reference numeral 2-10 denotes an area subjected to complement in conventional discharge failure complement. In the fourth embodiment, the discharge failure nozzle 2-4 is positioned at the upper end of the nozzle array. Thus, the complement target area 2-10 can be divided into an area 2-10-1 where discharge failure complement can be done even by the prior art, and an area 2-10-2 where no discharge failure complement can be done by the prior art. The ultimate purpose is to perform discharge failure complement by using the two areas 2-10-1 and 2-10-2 so as not to degrade the image quality.

Referring to FIG. 14, the printhead 2-1 has upper/lower registration adjustment nozzles 2-11. This arrangement has conventionally been employed, and its original purpose is to adjust the mechanical attaching position error of the printhead. A detailed description, control method, and the like for the presence of such nozzles are not essential to the present invention, and will be omitted.

Figure 13A:
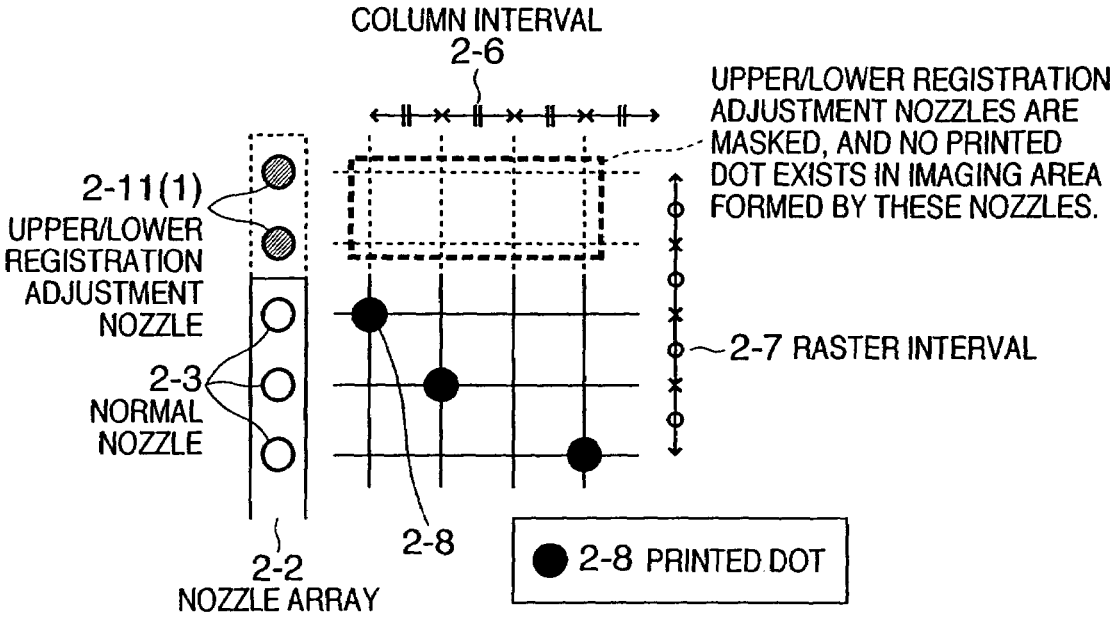
FIGS. 13A and 13B are views for explaining the principle of discharge failure complement according to the fourth embodiment.
Figure 13B:
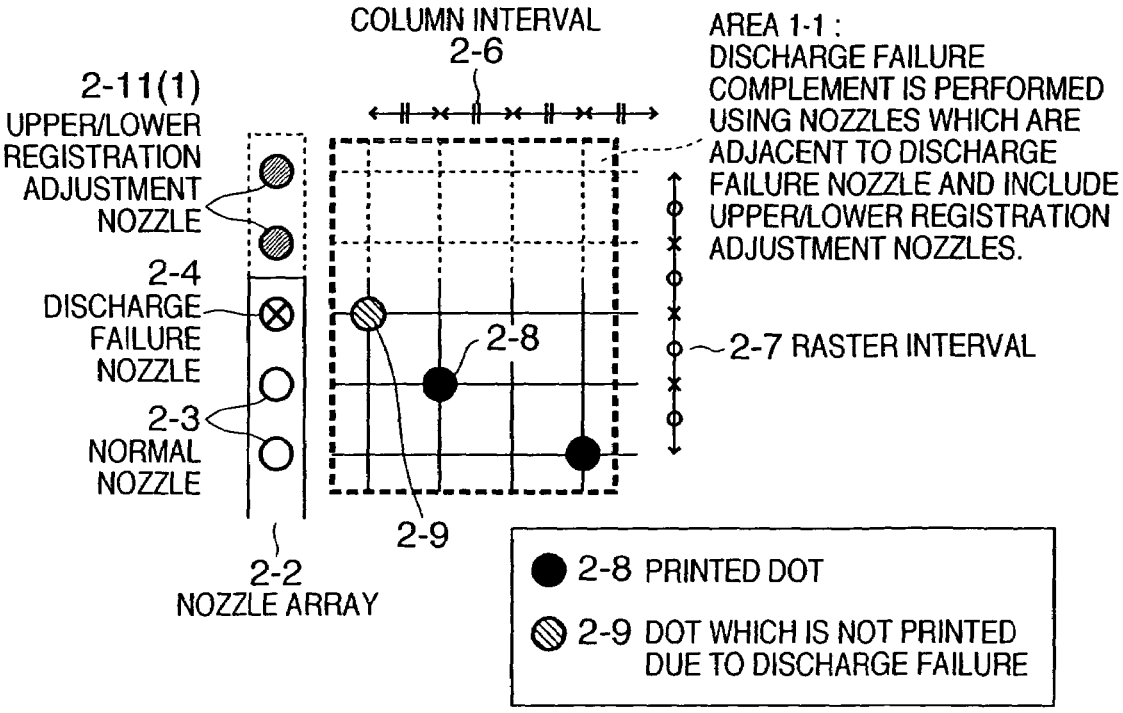

The fourth embodiment utilizes the upper/lower registration adjustment nozzles 2-11 for discharge failure complement. FIGS. 13A and 13B show this state.

FIG. 13A is a view showing a case in which no discharge failure nozzle exists. In this case, printing is done in a normal fashion, and the upper/lower registration adjustment nozzles 2-11 are not used. More specifically, the upper/lower registration adjustment nozzles are masked, and no printed dot exists in an imaging area formed by the nozzle.

FIG. 13B is a view showing a case in which a discharge failure nozzle exists. In this case, the upper/lower registration adjustment nozzles 2-11 are unmasked, and discharge failure complement is performed using nozzles which are adjacent to the discharge failure nozzle and include the upper/lower registration adjustment nozzles 2-11. The discharge failure complement algorithm is the same as the conventional one.

The principle of the fourth embodiment has been described. For easier understanding, a "discharge failure complement algorithm" employed in the fourth embodiment will be additionally described.

FIGS. 17A to 17D are views most simply expressing the discharge failure complement algorithm.

Figure 17A:
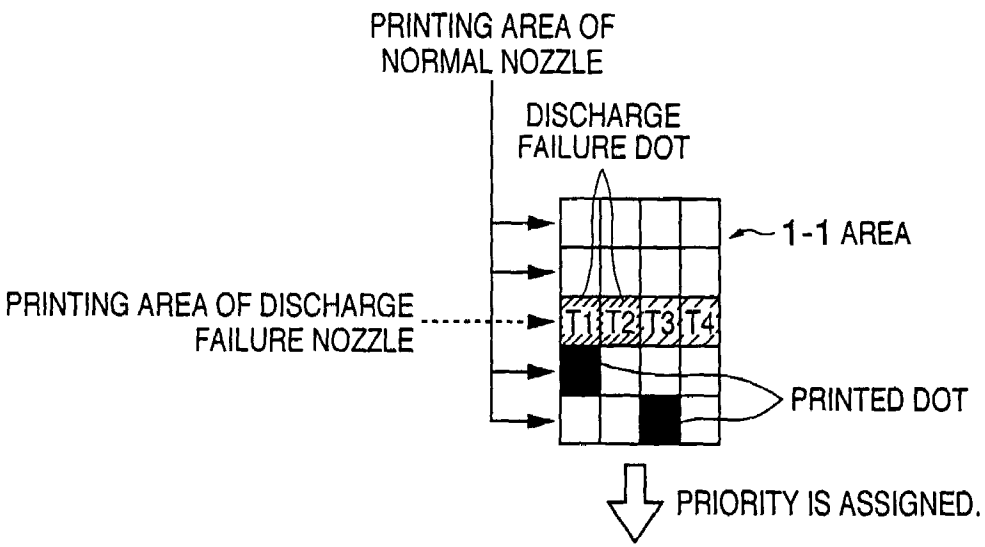
FIGS. 17A to 17D are views for explaining a discharge failure complement algorithm according to the fourth embodiment.

FIG. 17A is a view showing one extracted complement target area 1-1 in FIG. 13B. The complement target area 1-1 contains two printed dots and two dots which have not been printed due to a discharge failure. For descriptive convenience, the positions of discharge failure dots on respective columns will be called T1, T2, T3, and T4 from the left dot (T is the initial letter of a target for discharge failure complement).

Figure 17B:
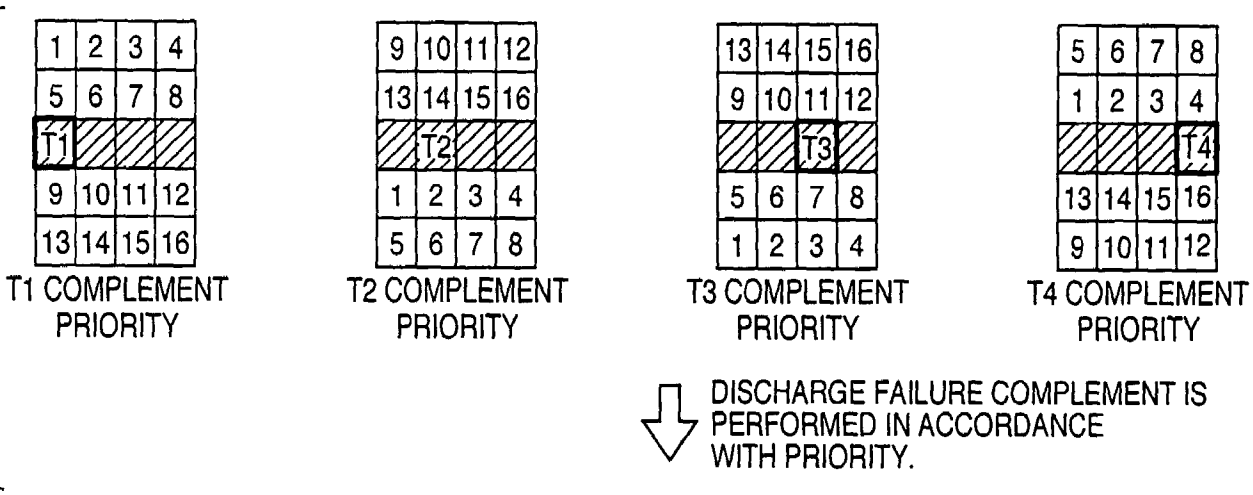

FIG. 17B shows states in which priorities for complementing discharge failure dots are assigned to dot positions at which not a discharge failure nozzle but a normal printing nozzle exists and can print, other than the positions of discharge failure dots, in order to complement discharge failure dots shown in FIG. 17A. In this stage, priority numbers are assigned regardless of whether a dot to be printed exists at a dot position to be assigned a priority. This process also corresponds to the description of FIG. 13B except that different priorities are assigned to discharge failure dots T1, T2, T3, and T4. In addition, since the number of positions subjected to discharge failure complement increases from four to 16, priorities (1) to (16) are assigned in FIG. 17B, instead of priorities (1) to (4) in FIG. 13B. These priorities may be assigned to T1, T2, T3, and T4 by the same pattern. However, to achieve the purpose of the fourth embodiment, the priorities are desirably assigned by different patterns, as shown in FIG. 17B.

Figure 17C:
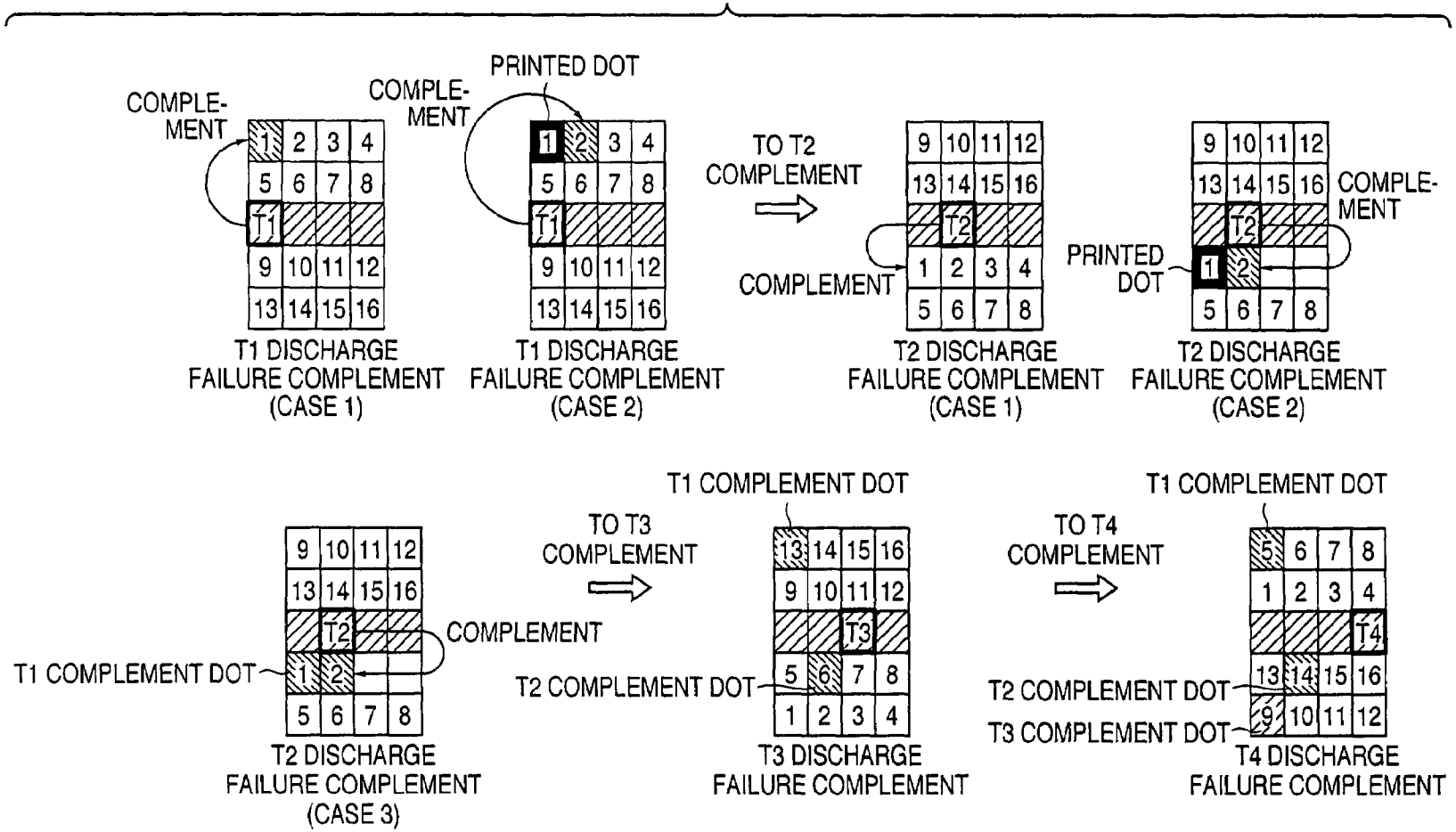

FIG. 17C shows states in which discharge failure dots are complemented in accordance with the discharge failure complement priorities assigned as shown in FIG. 17B. In FIG. 17C, the pattern of printed dots in the area 1-1 is not fixed, unlike FIG. 17A. FIG. 17C illustrates how to perform discharge failure complement for T1, T2, T3, and T4 in some cases.

A case in which a printed dot exists at the position of discharge failure dot T1 will be explained. T1 discharge failure complement (case 1) is an example of this case. In case 1, no printed dot and one dot which has not been printed due to a discharge failure exist. In this case, the dot which has not been printed due to a discharge failure directly shifts to a position of the highest discharge failure complement priority (i.e., dot complement is executed). In case 1, this position is a dot position having discharge failure complement priority (1).

Another example of T1 discharge failure complement (case 2) will be examined. In case 2, one printed dot and one dot which has not been printed due to a discharge failure exist. The printed dot exists at a position having discharge failure complement priority (1). In this case, the dot which has not been printed due to a discharge failure shifts to a position of the highest discharge failure complement priority except discharge failure complement priority (1). In case 2, this position is a dot position having discharge failure complement priority (2) in FIG. 17C.

A case in which a printed dot exists at the position of discharge failure dot T2 will be described. Assume that the T2 discharge failure complement process must be performed after the end of the T1 process. T2 discharge failure complement (case 1) is an example of this case. In case 1, no printed dot and one dot which has not been printed due to a discharge failure exist. In this case, the dot which has not been printed due to a discharge failure is directly complemented at a position of the highest discharge failure complement priority. In case 1, this position is a dot position having discharge failure complement priority (1).

Another example of T2 discharge failure complement (case 2) will be examined. In case 2, one printed dot and one dot which has not been printed due to a discharge failure exist. In this case, the printed dot exists at a position having discharge failure complement priority (1). In this case, the dot which has not been printed due to a discharge failure shifts to a position of the highest discharge failure complement priority except discharge failure complement priority (1). In case 2, this position is a dot position having discharge failure complement priority (2) in FIG. 17C.

Still another example of T2 discharge failure complement (case 3) will be examined. In case 3, one dot which has not been printed due to a discharge failure and one complement dot (assumed to have been generated in the T1 process preceding to the T2 process) exist. The complement dot exists at a position having discharge failure complement priority (1). In this case, the dot which has not been printed due to a discharge failure shifts to a position of the highest discharge failure complement priority except discharge failure complement priority (1). In case 3, this position is a dot position having discharge failure complement priority (2) in FIG. 17C.

The discharge failure complement process is executed in order of T1→T2, and then the process is executed by the same algorithm in order of T3, T4.

This will be explained briefly. In T3 discharge failure complement of FIG. 17C, if a printed dot exists at the position of discharge failure dot T3, the complement process is done using a dot except complement dots formed at T1 and T2 and original printed dots. In T3 discharge failure complement, complement is performed at a position having discharge failure complement priority (1). If no printed dot exists at the position of discharge failure dot T3, no process is done. Also in T4 discharge failure complement of FIG. 17C, if a printed dot exists at the position of discharge failure dot T4, the complement process is done using a dot except complement dots formed at T1, T2, and T3 and original printed dots. In T4 discharge failure complement, complement is performed at a position having discharge failure complement priority (1). If no printed dot exists at the position of discharge failure dot T4, no process is done.

Figure 17D:
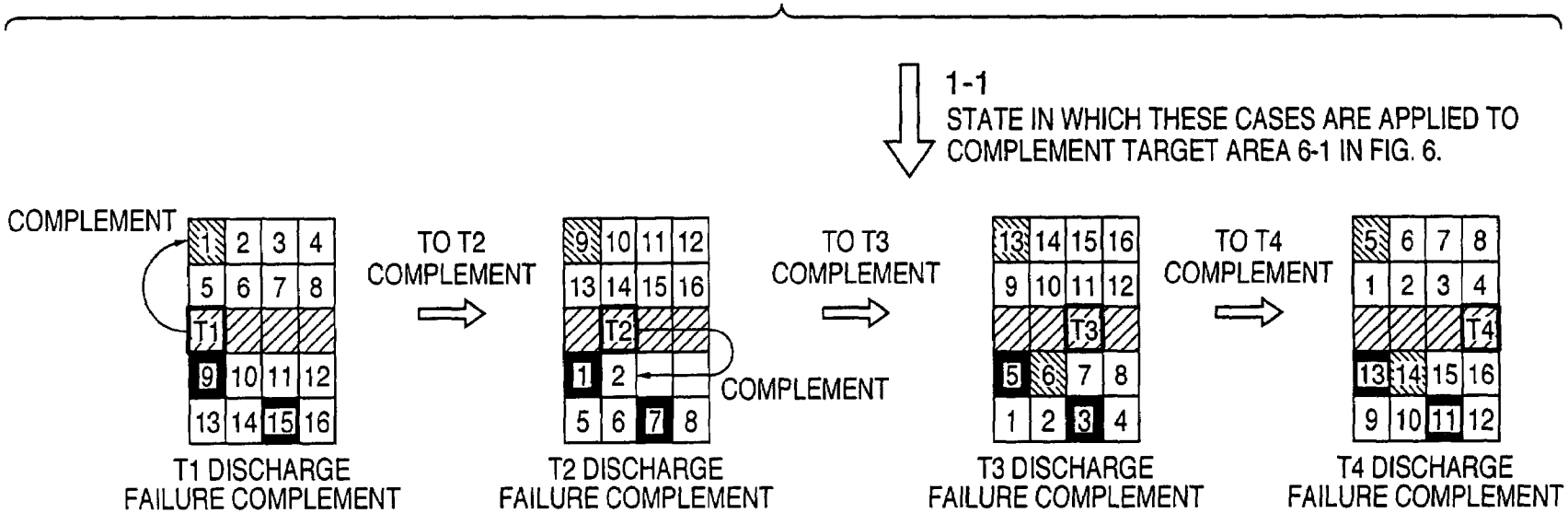

FIG. 17D shows states in which this algorithm is applied to execute discharge failure complement in the example of FIG. 17A. FIG. 17D assumes that discharge failure complement priorities for discharge failure dots are assigned in the order of FIG. 17B before complement. T1 discharge failure complement of FIG. 17D illustrates a state in which T1 discharge failure complement is done. A printed dot exists at the position of discharge failure dot T1, and no printed dot exists at a position of discharge failure complement priority (1). Thus, discharge failure dot T1 is moved to the position of discharge failure complement priority (1).

The T2 process is executed next, and this state is illustrated in T2 discharge failure complement of FIG. 17D. A printed dot exists at the position of discharge failure dot T2, and a printed dot exists at the position of discharge failure complement priority (1). The second highest discharge failure complement priority is searched for to detect that a position having discharge failure complement priority (2) is blank. Thus, discharge failure dot T2 is moved to the position of discharge failure complement priority (2).

The T3 process is executed next, and this state is illustrated in T3 discharge failure complement of FIG. 17D. In this case, no printed dot exists at the position of discharge failure dot T3, and no complement process is performed.

The T4 process is executed next, and this state is illustrated in T4 discharge failure complement of FIG. 17D. In this case, no printed dot exists at the position of discharge failure dot T4, and no complement process is performed.

The features of the principle necessary to implement the fourth embodiment will be briefly summarized. In the first embodiment, when the printhead includes a discharge failure nozzle and data to be printed exists at the position of the discharge failure nozzle, dots to be printed are moved to upper and lower normally printable nozzles around the discharge failure nozzle (in the first embodiment, the normally printable nozzles are assumed to be two upper nozzles and two lower nozzles of the discharge failure nozzle). In the fourth embodiment, the complement area is widened, and the dots of the discharge failure nozzle are complemented within an area of several columns (assumed to be four columns in the principle). Further, discharge failure complement priorities can be set for discharge failure dots present in respective columns.

By using the upper/lower registration adjustment nozzles 2-11 and the discharge failure complement algorithm of the fourth embodiment, degradation of a printed image is prevented by complementing discharge failure dots uniformly by upper and lower nozzles even if a discharge failure exists at the uppermost or lowermost end of the head (the principle has been described in only a case in which a discharge failure exists at the uppermost end of the head, but this also applies to a case in which a discharge failure exists at the lowermost end).

In addition, the fourth embodiment has described the upper/lower registration adjustment nozzles 2-11 set in the printhead in advance as if they were accidentally used for discharge failure complement. In some systems, the upper/lower registration adjustment nozzles 2-11 may be defined as nozzles dedicated to discharge failure complement, and if no discharge failure nozzle exists, may not be used. If the upper/lower registration adjustment nozzles are unnecessary, they need not be used to correct an error of the mechanical arrangement. The mechanism of nozzles dedicated to discharge failure complement may be exactly the same as a conventional method of controlling upper/lower registration adjustment nozzles.

The principle necessary to implement the fourth embodiment has been described.

(2) Arrangement and Data Flow

The electrical circuit configuration of a printer necessary to implement the fourth embodiment is the same as that of the first embodiment shown in FIGS. 11 and 12, and a description thereof will be omitted.

The internal configuration of an ASIC E1102 and its data flow will be roughly explained with reference to FIG. 3 again showing the first embodiment.

In a description of the data flow of the discharge failure complement function, two elements are necessary in addition to the ASIC E1102 for easy understanding of the function. One element is a personal computer (PC) 3-2 serving as a host device which is connected outside the printer and performs transmission of printing data to the printer, control of the printer, and the like in accordance with a driver program. The other element is a printhead 3-3. The PC 3-2 exists outside the printer incorporating the discharge failure complement function of the fourth embodiment. The PC 3-2 transfers printing data to the printer, more strictly, to the data reception unit of the ASIC E1102. The printhead 3-3 is a head which generates a printed output as a printer product. As described in the principle, the printhead 3-3 includes a discharge failure nozzle in addition to normal printing nozzles. Data for controlling the operation of the printhead 3-3, i.e., printing data, a discharge pulse signal, and the like are generated within the ASIC E1102.

The internal configuration of the ASIC E1102 will be explained.

Main blocks will be described. Reference numeral 3-4 denotes a CPU which controls and manages the whole operation of the ASIC E1102; and 3-5, an SD-RAM serving as a main memory for the printer system of the fourth embodiment. The main memory need not always be an SD-RAM, and may be a memory such as a D-RAM or S-RAM other than the SD-RAM as far as the memory belongs to the definition of the RAM. The remaining blocks in the ASIC E1102 form a so-called random logic part which implements an operation unique to the printer and an operation unique to the discharge failure complement function according to the fourth embodiment.

The random logic part will be explained.

Reference numeral 3-1-1 denotes an interface unit which receives data transferred from the PC 3-2. For example, the interface unit 3-1-1 receives a signal in accordance with an interface protocol complying with IEEE1284, USB, IEEE1394, or the like, and generates data in a format easily processible by the ASIC E1102 (in general, data is shaped into each byte). Data received into the ASIC E1102 via the interface unit 3-1-1 is sent to a reception data control unit 3-1-2. The function of the reception data control unit 3-1-2 is to receive data from the interface unit 3-1-1 and save the data in the SD-RAM 3-5. Part of the SD-RAM 3-5 that is controlled by the reception data control unit 3-1-2 is often called a reception buffer.

Data saved in the SD-RAM 3-5 by the reception data control unit 3-1-2 is loaded into a printing data generation unit 3-1-4 in accordance with each printing control timing, thus generating printing data. In general, the printing data generation unit 3-1-4 is divided into various functions for different roles such as an H-V conversion unit, data mapping unit, and multi-pass mask control unit. When the respective functions access the SD-RAM 3-5 and perform data processes by their own functions, access areas in the SD-RAM 3-5 are generally called by different names, i.e., a work buffer, print buffer, mask buffer, and the like. These functions are substantially irrelevant to the discharge failure complement function and are called a "printing data generation unit" as a whole, and a detailed description thereof will be omitted.

Printing data created by the printing data generation unit 3-1-4 is saved in a printing data storage S-RAM 3-1-5. The printing data storage S-RAM 3-1-5 is not indispensable to the system. In many cases, recent printers generate a large amount of printing data in advance to increase the printing speed. Such printing data is often temporarily stored in a high-speed accessible memory such as an S-RAM (in this case, a D-RAM memory is not proper because of a long access time). It is important that the target printing data is data having completely undergone various data processes such as a multi-pass process, index data mapping, and a mask process. The data can be printed immediately when the printing data is sent to a printhead control unit. The discharge failure complement function of the fourth embodiment further executes the discharge failure complement process for the data.

Printing data is read out from the printing data storage S-RAM 3-1-5 to a printing data read unit 3-1-6. At this time, if no discharge failure nozzle exists in the printhead 3-3, the data read out to the printing data read unit 3-1-6 is directly sent to a printhead control unit 3-1-7. The printhead control unit 3-1-7 performs hardware control unique to the printhead 3-3 so that the printhead control unit 3-1-7 transfers the received printing data to the printhead 3-3 or transfers a heat pulse signal to the printhead 3-3.

The ASIC E1102 also comprises a printing timing generation unit 3-1-8 which generates various printing timings from the encoder signal E1020. The printing timing generation unit 3-1-8 generates signals at a proper interval from the encoder signal E1020 so as to allow the printing data generation unit 3-1-4, the printing data read unit 3-1-6, the printhead control unit 3-1-7, and a discharge failure complement data read unit 3-6-7 (to be described later) to exchange data at proper timings.

Parts associated with the discharge failure complement function of the fourth embodiment will be explained. Blocks associated with the discharge failure complement function are blocks in the area of a discharge failure complement block 3-6 surrounded by the broken line in the ASIC E1102.

A discharge failure information storage unit 3-6-1 is necessary, and sets a nozzle position at which a discharge failure nozzle exists in the printhead. This setting is done by the CPU 3-4. Discharge failure nozzle information set in the discharge failure information storage unit 3-6-1 is transferred to a discharge failure complement data extraction timing generation unit 3-6-2, the printing data read unit 3-1-6, and a discharge failure-complemented data generation unit 3-6-8.

The discharge failure complement data extraction timing generation unit 3-6-2 generates a discharge failure complement data extraction timing signal on the basis of the transferred data. The printing data generation unit 3-1-4 can generate data of the current nozzle (regardless of whether the nozzle is a normal one or discharge failure one) of the printhead 3-3, and determine whether data is written in the printing data storage S-RAM 3-1-5. By receiving from the printing data generation unit 3-1-4 information on the relationship between currently processed printing data and a nozzle in the printhead 3-3, it can be determined whether the currently processed data is discharge data of a discharge failure nozzle or discharge data of upper and lower nozzle positions of the discharge failure nozzle at which discharge failure complement should be executed, as described in the principle. If the printhead is free from any discharge failure nozzle, the discharge failure complement data extraction timing generation unit 3-6-2 does not output any signal.

Based on the data, the discharge failure complement data extraction timing generation unit 3-6-2 notifies a discharge failure complement data extraction unit 3-6-3 of a timing at which discharge failure complement data (discharge failure complement data represents both discharge data of a discharge failure nozzle and printing data of a normal nozzle position subjected to discharge failure complement) is received. The discharge failure complement data extraction unit 3-6-3 is connected to a signal line for printing data output from the printing data generation unit 3-1-4. The discharge failure complement data extraction unit 3-6-3 can extract only discharge failure complement data from printing data in accordance with the timing notified by the discharge failure complement data extraction timing generation unit 3-6-2.

The extracted discharge failure complement data is transferred to a discharge failure complement algorithm execution unit 3-6-4. The discharge failure complement algorithm execution unit 3-6-4 is a block which performs discharge failure complement data calculation described in the principle.

According to the above-described principle, discharge failure complement data calculation requires discharge failure complement priority. Thus, a discharge failure complement priority setting unit 3-6-5 in the discharge failure complement block 3-6 transfers discharge failure complement priority data to the discharge failure complement algorithm execution unit 3-6-4. The discharge failure complement priority setting unit 3-6-5 has a function capable of setting discharge failure complement priority in accordance with setting by the CPU 3-4. By arranging the discharge failure complement priority setting unit 3-6-5, the discharge failure complement priority can be flexibly changed by firmware even after the ASIC E1102 is designed and manufactured.

The discharge failure complement algorithm execution unit 3-6-4 is an important function in the fourth embodiment, and will be described in detail with reference to the accompanying drawings.

Figure 18:
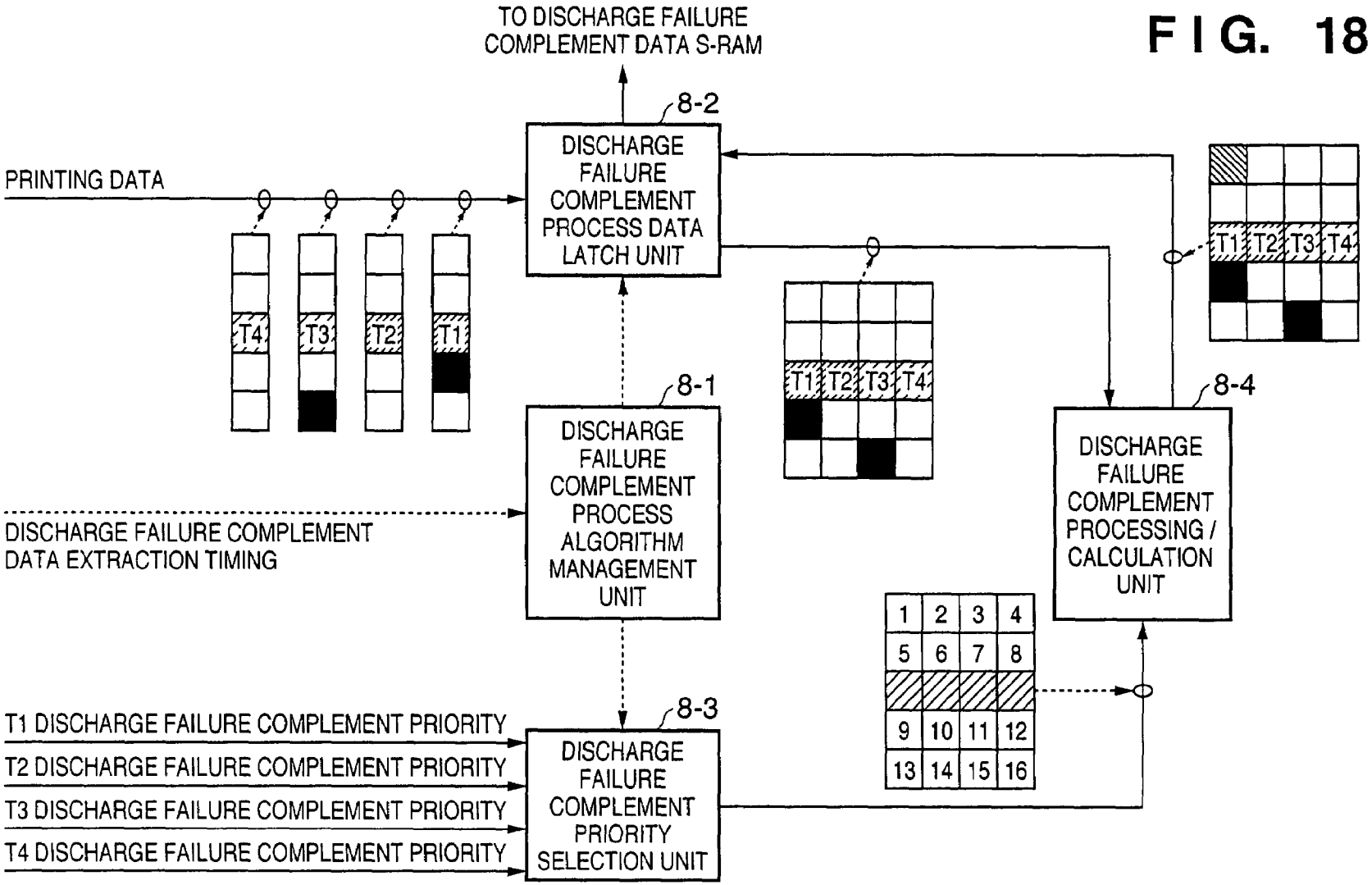
FIG. 18 is a view showing the configuration of a discharge failure complement algorithm execution unit as a component in the discharge failure complement system according to the fourth embodiment.

FIG. 18 shows the discharge failure complement algorithm execution unit 3-6-4. Respective components and the data flow between them will be explained.

Before a description, the following settings must be done for discharge failure complement of the fourth embodiment. As shown in FIG. 18, discharge failure complement is performed in a range defined by two upper normal nozzle positions and two lower normal nozzle positions of a discharge failure nozzle and four columns, as described in the principle. The discharge failure process is executed in order of T1→T2→T3→T4, as described in the principle.

The discharge failure complement algorithm execution unit 3-6-4 receives a signal from the discharge failure complement data extraction timing generation unit 3-6-2, and receives discharge failure complement data. Unlike the first embodiment, after discharge failure complement data are received by a range of four columns, sequential control to perform calculation for the respective columns is necessary. This control requires a discharge failure complement algorithm management unit 8-1 which controls the overall operation. This block receives a signal from the discharge failure complement data extraction timing generation unit 3-6-2, and outputs a signal on the basis of the received signal so as to cause a discharge failure complement data latch unit 8-2 to latch discharge failure complement data. After discharge failure complement data of four columns are latched, the discharge failure complement algorithm management unit 8-1 starts the discharge failure complement process.

The latched discharge failure complement data (as is apparent from FIG. 18, data has a bit width of 20 bits in the fourth embodiment) is always output from the discharge failure complement data latch unit 8-2 to a discharge failure complement process calculation unit 8-4 regardless of the operation clock. As for discharge failure complement priority data, as shown in FIG. 18, four data patterns are transferred from the discharge failure complement priority setting unit 3-6-5 for conversion at T1 to T4. Discharge failure complement priority data must be appropriately selected in accordance with the position of the current discharge failure dot during conversion. For this reason, the discharge failure complement algorithm management unit 8-1 processes a discharge failure dot at position T1, and transfers a signal to a discharge failure complement priority selection unit 8-3 so as to output discharge failure complement priority data for processing T1.

The discharge failure complement data of four columns output from the discharge failure complement data latch unit 8-2 and the discharge failure complement priority data for processing T1 that is output from the discharge failure complement priority selection unit 8-3 are input to the discharge failure complement processing/calculation unit 8-4.

Figure 19:
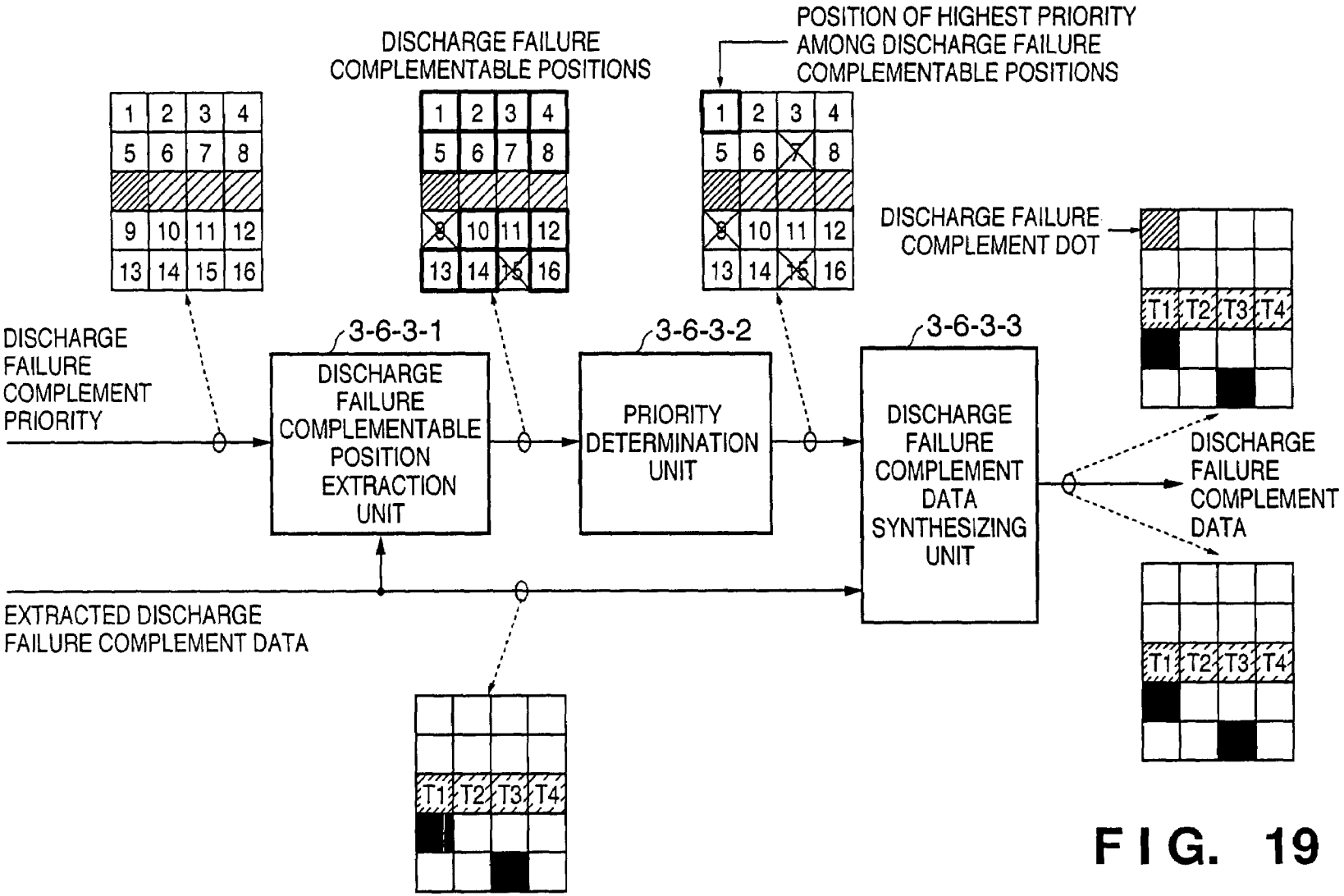
FIG. 19 is a view showing the configuration of a discharge failure complement processing/calculation unit as a component in the discharge failure complement system according to the fourth embodiment.

The function of the discharge failure complement processing/calculation unit 8-4 provides the discharge failure complement algorithm described in the principle. FIG. 19 is a block diagram showing the mechanism of the discharge failure complement processing/calculation unit 8-4. More specifically, a discharge failure complementable position extraction unit 3-6-3-1 determines discharge failure complementable positions from discharge failure complement data and discharge failure complement priority data for processing T1. A priority determination unit determines a position of the highest priority among the discharge failure complementable positions. At last, a discharge failure complement data synthesizing unit performs discharge failure complement on the basis of the discharge failure complement data and the position of the highest priority among the discharge failure complementable positions. If printing data exists at the position of discharge failure dot T1, the printing data is moved to a position of the highest priority among discharge failure complementable positions. If no printing data exists at the position of discharge failure dot T1, input printing data is directly output. Discharge failure complement is executed in accordance with this flow.

It is important that the function of the discharge failure complement processing/calculation unit 8-4 can be formed by only a combinational circuit. Simultaneously when discharge failure complement data of four columns and discharge failure complement priority data for processing T1 are input, discharge failure-complemented data is logically output (regardless of whether printing data exists at T1). In practice, however, a given gate delay may be posed between input and output. Thus, the discharge failure complement algorithm management unit 8-1 waits until proper operation clocks (two clocks in the fourth embodiment, as described in the above embodiments) are input. After that, the discharge failure complement algorithm management unit 8-1 transfers a signal to the discharge failure complement process data latch unit 8-2 so as to update, as new discharge failure complement data of four columns, data output from the discharge failure complement processing/calculation unit 8-4. The discharge failure complement process data latch unit 8-2 which latches the new discharge failure complement data of four columns having undergone discharge failure complement for printed dot T1 outputs the data to the discharge failure complement processing/calculation unit 8-4 again.

In order to process a discharge failure dot at position T2, the discharge failure complement algorithm management unit 8-1 transfers a signal to the discharge failure complement priority selection unit 8-3 so as to output discharge failure complement priority data for processing T2. The discharge failure complement processing/calculation unit 8-4 receives the discharge failure complement data of four columns having undergone discharge failure complement for printed dot T1, and the discharge failure complement priority data for processing T2. The discharge failure complement processing/calculation unit 8-4 outputs the discharge failure complement data of four columns having undergone discharge failure complement for printed dots T1 and T2 after a proper gate delay in accordance with the above-described procedures. The discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 and T2 outputs the data to the discharge failure complement processing/calculation unit 8-4 again.

In order to process a discharge failure dot at position T3, the discharge failure complement algorithm management unit 8-1 transfers a signal to the discharge failure complement priority selection unit 8-3 so as to output discharge failure complement priority data for processing T3. The discharge failure complement processing/calculation unit 8-4 receives the discharge failure complement data of four columns having undergone discharge failure complement for printed dots T1 and T2, and the discharge failure complement priority data for processing T3. The discharge failure complement processing/calculation unit 8-4 outputs the discharge failure complement data of four columns having undergone discharge failure complement for printed dots T1 to T3 after a proper gate delay in accordance with the above-described procedures. The discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 to T3 outputs the data to the discharge failure complement processing/calculation unit 8-4 again.

In order to process a discharge failure dot at position T4, the discharge failure complement algorithm management unit 8-1 transfers a signal to the discharge failure complement priority selection unit 8-3 so as to output discharge failure complement priority data for processing T4. The discharge failure complement processing/calculation unit 8-4 receives the discharge failure complement data of four columns having undergone discharge failure complement for printed dots T1 to T3, and the discharge failure complement priority data for processing T4. The discharge failure complement processing/calculation unit 8-4 outputs the discharge failure complement data of four columns having undergone discharge failure complement for printed dots T1 to T4 after a proper gate delay in accordance with the above-described procedures. The discharge failure complement algorithm management unit 8-1 waits until proper operation clocks are input. After that, the discharge failure complement algorithm management unit 8-1 transfers a signal to the discharge failure complement process data latch unit 8-2 so as to update, as new discharge failure complement data of four columns, the data output from the discharge failure complement processing/calculation unit 8-4. The discharge failure complement process data latch unit 8-2 which latches the new discharge failure complement data of four columns having undergone discharge failure complement for printed dots T1 to T4 transfers the data, i.e., the discharge failure complement data of four columns having undergone discharge failure complement to a discharge failure complement data S-RAM 3-6-6. The discharge failure complement process for discharge failure complement of four columns ends.

A subsequent internal function of the ASIC 1102 will be described again with reference to FIG. 3.

Discharge failure-complemented data as a product of the discharge failure complement algorithm execution unit 3-6-4 is written in the discharge failure complement data S-RAM 3-6-6. The discharge failure complement data S-RAM 3-6-6 corresponds to the printing data storage S-RAM 3-1-5 which stores printing data. The discharge failure-complemented data is final printing data, and may be stored in the printing data storage S-RAM 3-1-5. In this case, the number of write blocks to the printing data storage S-RAM 3-1-5 is two, i.e., the printing data generation unit 3-1-4 and discharge failure complement algorithm execution unit 3-6-4. Bus arbitration and conflict may occur and decrease the performance of the printer system. To prevent this, an S-RAM is arranged for only discharge failure-complemented data. However, when the performance of the printer system abruptly improves, the printing data storage S-RAM 3-1-5 may store discharge failure-complemented data.

The discharge failure-complemented data written in the discharge failure complement data S-RAM 3-6-6 is read out by the discharge failure complement data read unit 3-6-7 at a specified timing. The specified timing means that the discharge failure complement data read unit 3-6-7 is synchronized with the printing data read unit 3-1-6. More specifically, the printing data storage S-RAM 3-1-5 stores both printing data of a normal nozzle and printing data of a discharge failure nozzle. The discharge failure complement data S-RAM 3-6-6 stores only printing data of nozzles (two upper nozzles and two lower nozzles on the assumption of the fourth embodiment) around the discharge failure nozzle. The purpose of the fourth embodiment is to appropriately set data (printing data of nozzles around the discharge failure nozzle, i.e., discharge failure-complemented data) of the discharge failure complement data S-RAM 3-6-6 in data (printing data including both printing data of a normal nozzle and discharge failure nozzle) of the printing data storage S-RAM 3-1-5. While the printing data read unit 3-1-6 reads out data of a nozzle concerning, discharge failure complement, corresponding data is also read out from the discharge failure complement data S-RAM 3-6-6. These two data must be properly set (it is also possible to form a sequential circuit which reads out these two data at different timings and properly sets the two data later. In this case, the sequential circuit increases in scale, and is not a desirable means in terms of providing a simple, small-scale system at low cost). For this reason, the discharge failure complement data read unit 3-6-7 must read out discharge failure-complemented data on the basis of a signal from the printing data read unit 3-1-6 in synchronism with the signal. The printing data read unit 3-1-6 determines whether printing data currently read out by the unit 3-1-6 concerns discharge failure complement, and then outputs a signal to the discharge failure complement data read unit 3-6-7. Thus, the printing data read unit 3-1-6 requires discharge failure nozzle information output from the discharge failure information storage unit 3-6-1.

Discharge failure-complemented data which is read out by the discharge failure complement data read unit 3-6-7 is transferred to the discharge failure-complemented data generation unit 3-6-8 together with printing data (according to the above procedures, this printing data must be data of a nozzle position associated with discharge failure complement) synchronously read out by the printing data read unit 3-1-6. The data generation unit 3-6-8 sets the discharge failure-complemented data in the printing data.

Figure 15:
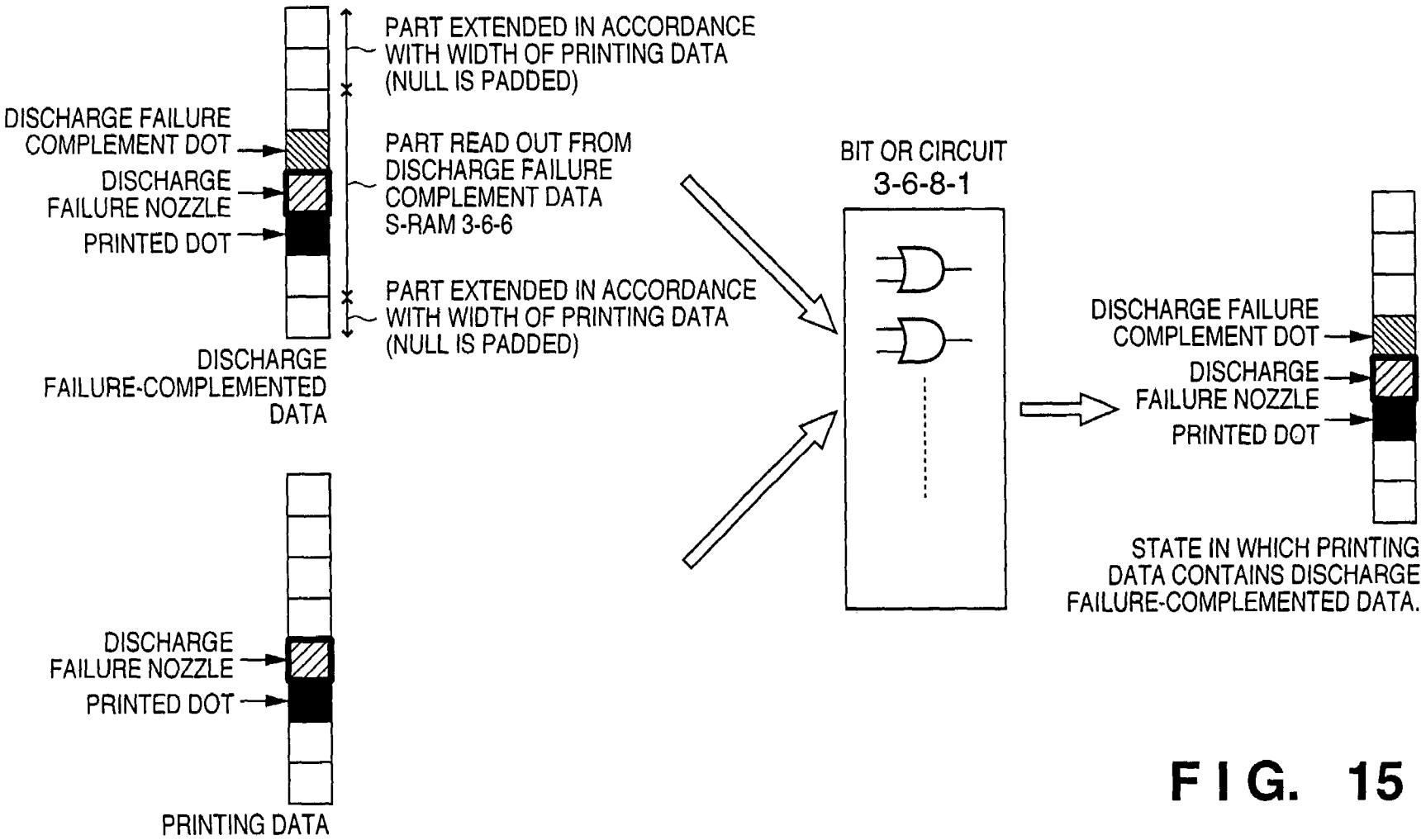
FIG. 15 is a view showing the configuration of a discharge failure-complemented data generation unit as a component in a discharge failure complement system according to the fourth embodiment.

FIG. 15 is a view showing this state. FIG. 15 illustrates an important mechanism in the fourth embodiment.

For descriptive convenience of the mechanism, a case in which a discharge failure nozzle exists at a position other than the uppermost or lowermost end of the nozzle array will be explained.

As described above, discharge failure-complemented data and printing data are input. The discharge failure-complemented data is extended to the same number of bits as that of printing data. In a general printer, printing data is processed for a multiple of eight such as bytes or words. However, discharge failure-complemented data may have a smaller number of bits (in the fourth embodiment, a total number of bits are five: one bit for a discharge failure nozzle, and four bits for nozzles subjected to discharge failure complement (because of two upper nozzles and two lower nozzles of the discharge failure nozzle)). In this case, the number of bits of discharge failure-complemented data must be adjusted to that of printing data. The fourth embodiment assumes that printing data is processed every eight bits (=one byte), as shown in FIG. 15. Discharge failure-complemented data must be extended from five bits to eight bits. The extension method simply decides positions to be extended on the basis of discharge failure nozzle position information transferred from the discharge failure information storage unit 3-6-1, and pads "0"s (NULL data) at positions to be extended. The printing data and the bit-extended data having undergone discharge failure complement are transferred to a bit OR circuit 3-6-8-1. The bits are ORed, and the calculation result is output as an output of the discharge failure-complemented data generation unit 3-6-8.

Referring to FIG. 15, discharge failure-complemented data (bit-extended data) which is an input to the discharge failure-complemented data generation unit 3-6-8 is identical to printing data containing the discharge failure-complemented data serving as an output from the discharge failure-complemented data generation unit 3-6-8.

The bit OR circuit 3-6-8-1 is not necessary in this case, but is necessary in some cases. The fourth embodiment assumes that nozzle printing data adjacent in the same 1-byte printing data are adjacent to each other similarly to nozzles of the printhead 3-3 (similar to the printhead 2-1 and nozzle array 2-2 shown in FIG. 14). However, in some printer systems, adjacent nozzle printing data may exist in different 1-byte printing data. This is based on the difference in printhead form or driving method, and printing data does not always have the format shown in FIG. 15. For this reason, it is necessary to process discharge failure-complemented data (extract necessary bits) and extend the data (pad "0"s in accordance with the bit width of the printing data) in accordance with the printing data format. In this case, the timing and the position at which data of a nozzle concerning discharge failure complement appears in printing data change. The printing data read unit 3-1-6 and discharge failure complement data read unit 3-6-7 must operate in cooperation with each other in accordance with the change.

Figure 16:
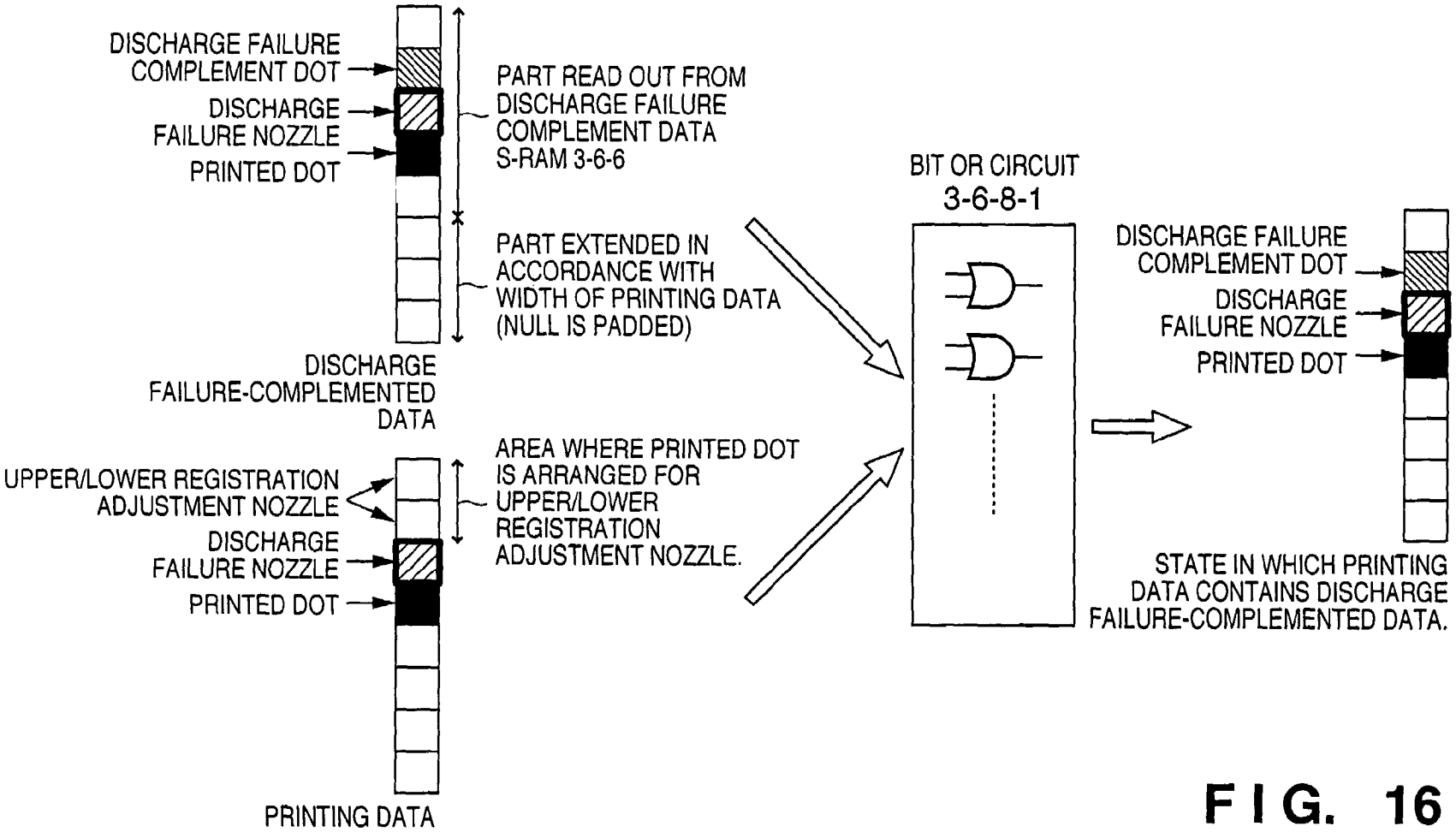
FIG. 16 is a view showing the configuration of the discharge failure-complemented data generation unit as a component in the discharge failure complement system according to the fourth embodiment.

A case in which a discharge failure nozzle exists at the uppermost or lowermost end of the nozzle array will be explained. FIG. 16 shows this state.

Printing data read out by the printing data read unit 3-1-6 should contain a data area for printing by the upper/lower registration adjustment nozzle. If no data area exists, no printing can be done using the upper/lower registration adjustment nozzle. For this reason, the upper/lower registration adjustment nozzle and the data area for printing by the nozzle must coexist. In general, "0"s must be arranged in this area (i.e., no printed dot is arranged for the upper/lower registration adjustment nozzle). In the description of the principle, the arrangement of "0"s in the area is called "masking of the upper/lower registration adjustment nozzle". There are proposed various mechanisms which arrange printed dots in the data area for printing by the nozzle in a normal state. For example, register setting by an MPU may be adopted, or a special area may be defined in a printing SRAM to read out data from the area. These mechanisms should be selected in accordance with the use purpose of the upper/lower registration adjustment nozzle, and are hardly related to the fourth embodiment.

First, as described above, discharge failure-complemented data and printing data containing the printing data area of the upper/lower registration adjustment nozzle are input. The discharge failure-complemented data is then extended to the same number of bits as that of printing data. This is the same mechanism as that described above. The printing data and the bit-extended data having undergone discharge failure complement are sent to the bit OR circuit 3-6-8-1. The bits are ORed, and the calculation result is output as an output of the discharge failure-complemented data generation unit 3-6-8.

Accordingly, the mechanism of arranging discharge failure-complemented printed dots for the upper/lower registration adjustment nozzle is completed.

The created printing data containing the discharge failure complement data is transferred to the printhead control unit 3-1-7, and the printhead control unit 3-1-7 executes printing in accordance with the protocol of the printhead 3-3. This process is the same as that in the absence of any discharge failure.

(3) Effects of Fourth Embodiment

As described above, the fourth embodiment adopts the upper/lower registration adjustment nozzle and the discharge failure complement algorithm of the first to third embodiments. Even when a discharge failure occurs at the uppermost or lowermost end of the head, degradation of a printed image is prevented by complementing discharge failure dots uniformly by upper and lower nozzles (the fourth embodiment has described only a case in which a discharge failure exists at the uppermost end of the head, but this also applies to a case in which a discharge failure exists at the lowermost end).

That is, a nozzle such as the 0th, −1st, 513th, or 514th nozzle which does not exist in a general nozzle array image in the prior art can be formed by utilizing the special upper/lower registration adjustment nozzle.

The above embodiments are not limited to the inkjet printing system, but can be applied to any printing system. Of inkjet printing systems, a bubble-jet printing system which discharges ink by using an electrothermal transducer for generating thermal energy achieves high-density, high-definition printing. The bubble-jet printing system can preferably adopt the discharge failure complement method of complementing an area unprinted due to a discharge failure by using a plurality of nozzles around a discharge failure nozzle.

As has been described above, the above embodiments provide a new concept and system of completing discharge failure complement within one scanning of the printhead in the main scanning direction. The discharge failure complement process which suffers various problems in a conventional method can be easily achieved.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priorities from Japanese Patent Application Nos. 2003-311341 filed on Sep. 3, 2003 and 2004-232501 filed on Aug. 9, 2004, which are hereby incorporated by reference herein.

What is claimed is:

1. A printing apparatus which prints by using an inkjet head having nozzle arrays formed by arraying a plurality of nozzles for discharging ink while scanning the inkjet head on a printing medium, the printing apparatus comprising:

storage means for storing a position of an abnormal nozzle which abnormally discharges ink among the plurality of nozzles arrayed in the nozzle arrays;

means for assigning data subjected to discharge by the abnormal nozzle to at least four normal nozzles in the nozzle array including the abnormal nozzle in accordance with predetermined priorities, which priorities are different for any two adjacent columns of print data, wherein the at least four normal nozzles discharge ink of the same color as the abnormal nozzle and wherein the data subjected to discharge by the abnormal nozzle is assigned, in accordance with the predetermined priorities, among at least two of the normal nozzles positioned at one side of the abnormal nozzle in the nozzle array including the abnormal nozzle and at least two of the normal nozzles positioned at the other side of the abnormal nozzle in the nozzle array including the abnormal nozzle; and means for controlling to perform assignment of data subjected to discharge by the abnormal nozzle every time column data along a scanning direction are created by a predetermined number of columns, wherein the inkjet head comprises a plurality of the nozzle arrays, and data for deciding the predetermined priorities is stored in correspondence with each of the plurality of nozzle arrays, and a stored priority is assigned to each nozzle array.

* * * * *